US008445172B2

(12) United States Patent
Shitara et al.

(10) Patent No.: US 8,445,172 B2
(45) Date of Patent: May 21, 2013

(54) METHOD FOR PRODUCING TONER AND TONER

(75) Inventors: Yasutada Shitara, Numazu (JP); Yoshihiro Norikane, Yokohama (JP); Yohichiroh Watanabe, Fuji (JP); Andrew Mwaniki Mulwa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 412 days.

(21) Appl. No.: 12/718,357

(22) Filed: Mar. 5, 2010

(65) Prior Publication Data

US 2010/0227267 A1 Sep. 9, 2010

(30) Foreign Application Priority Data

Mar. 6, 2009 (JP) ..... 2009-052962

(51) Int. Cl.
*G03G 5/00* (2006.01)

(52) U.S. Cl.
USPC ..... 430/137.1; 430/110.4; 430/137.14

(58) Field of Classification Search
USPC ..... 430/137.1, 137.14, 110.4
See application file for complete search history.

(56) References Cited

U.S. PATENT DOCUMENTS

2006/0142425 A1* 6/2006 Akioka et al. ..... 523/223
2006/0240354 A1* 10/2006 Ohtani ..... 430/137.1
2008/0063971 A1 3/2008 Watanabe et al.
2008/0227011 A1 9/2008 Kuramoto et al.
2008/0241727 A1 10/2008 Norikane et al.
2008/0248416 A1 10/2008 Norikane et al.
2008/0286680 A1* 11/2008 Norikane et al. ..... 430/110.4

FOREIGN PATENT DOCUMENTS

| | | |
|---|---|---|
| JP | 57-201248 | 12/1982 |
| JP | 7-152202 | 6/1995 |
| JP | 2003-248339 | 9/2003 |
| JP | 2006-77166 | 3/2006 |
| JP | 3786034 | 3/2006 |
| JP | 3786035 | 3/2006 |
| JP | 2006-293320 | 10/2006 |
| JP | 3874082 | 11/2006 |
| JP | 2008-257182 | 10/2008 |

* cited by examiner

*Primary Examiner* — Stewart Fraser

(74) *Attorney, Agent, or Firm* — Oblon, Spivak, McClelland, Maier & Neustadt, L.L.P.

(57) ABSTRACT

A method for producing a toner, containing: ultrasonically vibrating a liquid toner composition in which a toner material containing at least a binder resin and a colorant is dissolved or dispersed in a solvent; introducing the liquid toner composition to a liquid chamber, and ejecting the liquid toner composition as droplets from an ejecting plate having a plurality of holes and disposed on one surface of the liquid chamber; and drying and solidifying the droplets so as to produce a toner, wherein the ultrasonically vibrating is performed before the introducing the liquid toner composition to the liquid chamber.

14 Claims, 7 Drawing Sheets

METHOD FOR PRODUCING TONER AND TONER

BACKGROUND OF THE INVENTION

1. Field of the Invention

The present invention relates to a method for producing a toner that is applicable for a developer for developing an electrostatic image in electrophotography, and a toner produced by such the method.

2. Description of the Related Art

Conventionally, as a method for producing an electrophotographic toner used for copiers, printers, facsimiles or complex machines thereof on the basis of an electrophotographic recording method, only a pulverization method had been used. However, recently, a so-called polymerization method in which a toner is formed in an aqueous medium is widely used, and the polymerization method is more commonly used than the pulverization method (Japanese Patent Application Laid-Open (JP-A) No. 07-152202). The toner produced by the polymerization method is called "polymerized toner" or in some countries "chemical toner", and the polymerization method also include a production method including a polymerization process for convenience. Examples of such polymerization methods in practical use include a suspension polymerization method, an emulsion polymerization method, a polymer suspension (polymer aggregation) method, and ester elongation method.

The polymerization method has an advantage of obtaining a toner having a small particle diameter with ease, a sharp particle size distribution and a substantially spherical shape, compared to the pulverization method. On the other hand, it also has a disadvantage of poor deliquoring efficiency because toner particles are generally deliquored in an aqueous solvent and the polymerization process needs long time. Moreover, after toner particles are solidified and separated from the solvent, the toner particles need to be repeatedly washed and dried. Therefore, the process needs a long time, and a large amount of water and energy.

So-called a spray-dry method, that is a method such that a liquid in which a material is dissolved or dispersed in an organic solvent is jetted from one spray nozzle (spray pore) and does not require the atomization in the aqueous medium, has been performed for a long time (for example, see JP-A No. 57-201248). However, in the spray-dry method, the classification of the formed particles is required as the particle size distribution of the formed toner is broad, and as a result of the classification, the yield is very low.

As a method for solving the problem above, there has recently been proposed a method for forming a plurality of droplets from an orifice having a plurality of pores (nozzles) by applying a pressure pulse from a piezoelectric element (see Japanese Patent (JP-B) Nos. 3786034, and 3786035). As a modified version of this method, the present applicant has proposed a method in which droplets are ejected by vibrating a nozzle (see JP-A No. 2006-293320). Any of these methods (referred as "jet atomizing method" hereinafter) has characteristics to provide particles having a uniform particle diameter, as a plurality of pores (nozzles) are provided and droplets are ejected from each pore (nozzle) one by one.

A fixing device equipped in the general electrophotographic image forming device has a fixing member consisted of a roller or belt which are heated at high temperature, and a cleaning member. When the toner is pressed by the heated fixing member, the wax dispersed in the toner is fused and extruded from the toner to thereby present between the fixing member and the toner. As a result, the adhesion of the toner to the fixing member is reduced, and thus the toner adheres to a recording medium without adhering to the fixing member. This is so called an oilless fixing toner system, and has been a mainstream of the toner system (see JP-A No. 2003-248339, and JP-B No. 3874082). Accordingly, it is common for the raw material of the toner to contain a wax component, and the wax enables to be extruded into a space between the fixing member and the toner at the time of the fixing, by selecting the wax having no solubility to the binder resin.

In the jet atomizing method, which is a subject of the present invention, a liquid in which a toner material is dissolved or dispersed in a solvent (referred as a liquid toner composition hereinafter) is ejected from a nozzle having an extremely small diameter. Here, the binder resin of the toner material is dissolved in the solvent, but the components having different solubility to that of the binder resin, such as a pigment, wax, and a charge controlling agent, are present in the dispersed state which is small enough to the diameter of the nozzle. There is no problem for the liquid toner composition having such dispersed state. However, in the case where the liquid toner composition is left standing, and the dispersion is retained at one place due to a maintenance of a device, the dispersed raw material is slightly aggregated. The aggregated raw material sometimes has a size bigger than the diameter of the nozzle, causing the clogging of the nozzle. The clogging of the nozzle means that the ejection cannot be performed, and it is technically and operationally difficult to remove the clogged material. Therefore, the occurrence of the nozzle clogging is a very serious problem for this production method.

The jet atomizing method, which is a subject of the present invention, does not any restriction for a liquid vibrating system for vibrating the liquid toner composition and a film vibrating system for vibrating the nozzle film. In any of the systems, the method essentially contains a step for applying vibration to the liquid toner composition. When the excess vibration is applied to the liquid toner composition, the cavitation of the liquid toner composition occurs, the vibrations of the toner dispersion in the jetting device and the vibrating film are significantly disturbed, and then the vibration cannot be controlled. As a result, the production efficiency is significantly lowered. Therefore, it is suggested that a degassing step be generally performed after forming the toner solution (see JP-A No. 2006-077166). However, this effect is lowered when the liquid toner composition is left standing, and thus this is not sufficient solution.

BRIEF SUMMARY OF THE INVENTION

An object of the present invention is to solve the aforementioned problem in the jet atomizing method, specifically, to attain a stable ejecting performance in the jet atomizing method without causing nozzle clogging due to dispersed matters contained in a liquid toner composition.

The means for solving are as follow:

<1> A method for producing a toner, containing:

ultrasonically vibrating a liquid toner composition in which a toner material containing at least a binder resin and a colorant is dissolved or dispersed in a solvent;

introducing the liquid toner composition to a liquid chamber, and ejecting the liquid toner composition as droplets from an ejecting plate having a plurality of holes and disposed on one surface of the liquid chamber; and drying and solidifying the droplets so as to produce a toner, wherein the ultrasonically vibrating is performed before the introducing the liquid toner composition to the liquid chamber.

<2> The method for producing a toner according to <1>, wherein a liquid vibration unit configured to vibrate the liquid toner composition is disposed on the side of the liquid chamber facing to the ejecting plate, and the liquid toner composition is repeatedly pushed out and suctioned from the ejecting plate by the liquid vibration unit so as to eject the droplets.

<3> The method for producing a toner according to <1>, wherein the ejecting plate is vibrated by an ejecting plate vibrating unit so as to eject the droplets.

<4> The method for producing a toner according to <3>, wherein the ejecting plate vibrating unit is a vibration ring constituted of a circular piezoelectric element bonded to an outer surface of the ejecting plate.

<5> The method for producing a toner according to any one of <2> to <4>, wherein either the liquid vibration unit or the ejecting plate vibrating unit is a piezoelectric element, and an ejection condition of the droplets ejected from the ejecting plate is controlled by a voltage applied to the piezoelectric element.

<6> The method for producing a toner according to any one of <2> to <5>, wherein either the liquid vibration unit or the ejecting plate vibrating unit is a piezoelectric element, and an ejection condition of the droplets ejected from the ejecting plate is controlled by a frequency of a voltage applied to the piezoelectric element.

<7> The method for producing a toner according to any one of <1> to <6>, wherein after ejecting the liquid toner composition from the ejecting plate as droplets, a fall velocity of the droplets is increased or decreased by a transporting air flow.

<8> A toner, obtained by the method for forming a toner as defined in any one of <1> to <7>.

<9> The toner according to <8>, wherein the toner has a particle size distribution in the range of 1.00 to 1.15, wherein the particle size distribution is a ratio of a mass average particle diameter to a number average particle diameter.

<10> The toner according to any of <8> or <9>, wherein the toner has a mass average particle diameter of 1 μm to 20 μm.

According to the present invention, there can be provided a method for forming a toner, which can maintain the ejecting performance of the toner for a long period of time, and as a result, can stably form a uniform toner for a long period of time.

As a result of the present invention, a toner having a particle size distribution close to monodispersibility, which has not been able to be achieved by the conventional method, such as a pulverizing method and a polymerization method, can be obtained. Moreover, the present invention can produce a toner having no change or extremely slight change in the various characteristics required for the toner, such as flowability and charging characteristics, which tend to change in the particles formed by the conventional production methods, and such toner can be used for a developer for developing a electrostatic image in electrophotography, electrostatic recording, electrostatic printing and the like, and a high quality image can be stably formed using such developer.

DETAILED DESCRIPTION OF THE INVENTION

The present invention has achieved under the consideration of the problem such that the jetting performance is lowered over time in the conventional jet atomizing method as has been mentioned in the related art. It is considered that this problem be caused by the clogging of a pore (nozzle) caused by the change in the dispersion state of the solid contents contained in the liquid toner composition.

In the present invention, the pigment and wax components dispersed as solid contents in dispersion are released from their aggregation states by ultrasonic vibrating the liquid toner composition just before the liquid toner composition enters the liquid chamber, to thereby prevent the clogging of the nozzle for a long period. Moreover, the occurrence of cavitation is suppressed at the same time, and thus the present invention is to provide a means to maintain the stable jetting performance and to stable produce the uniformed toner.

The present invention will be specifically explained hereinafter with reference to the preferred embodiment thereof.

At first, with reference to FIG. 1, the method for producing a toner of the present invention will be described.

The liquid toner composition 10 (may also referred as a material solution hereinafter) in which a toner material containing at least a binder resin and a pigment is dissolved or dispersed in a solvent is housed in a liquid chamber 13 (may also referred as a contained hereinafter) for housing the material solution.

The material solution for supplying to the liquid chamber is charged from a liquid supplying hole 20 and the excess material solution is discharged from the discharging hole 21.

Figure 1:
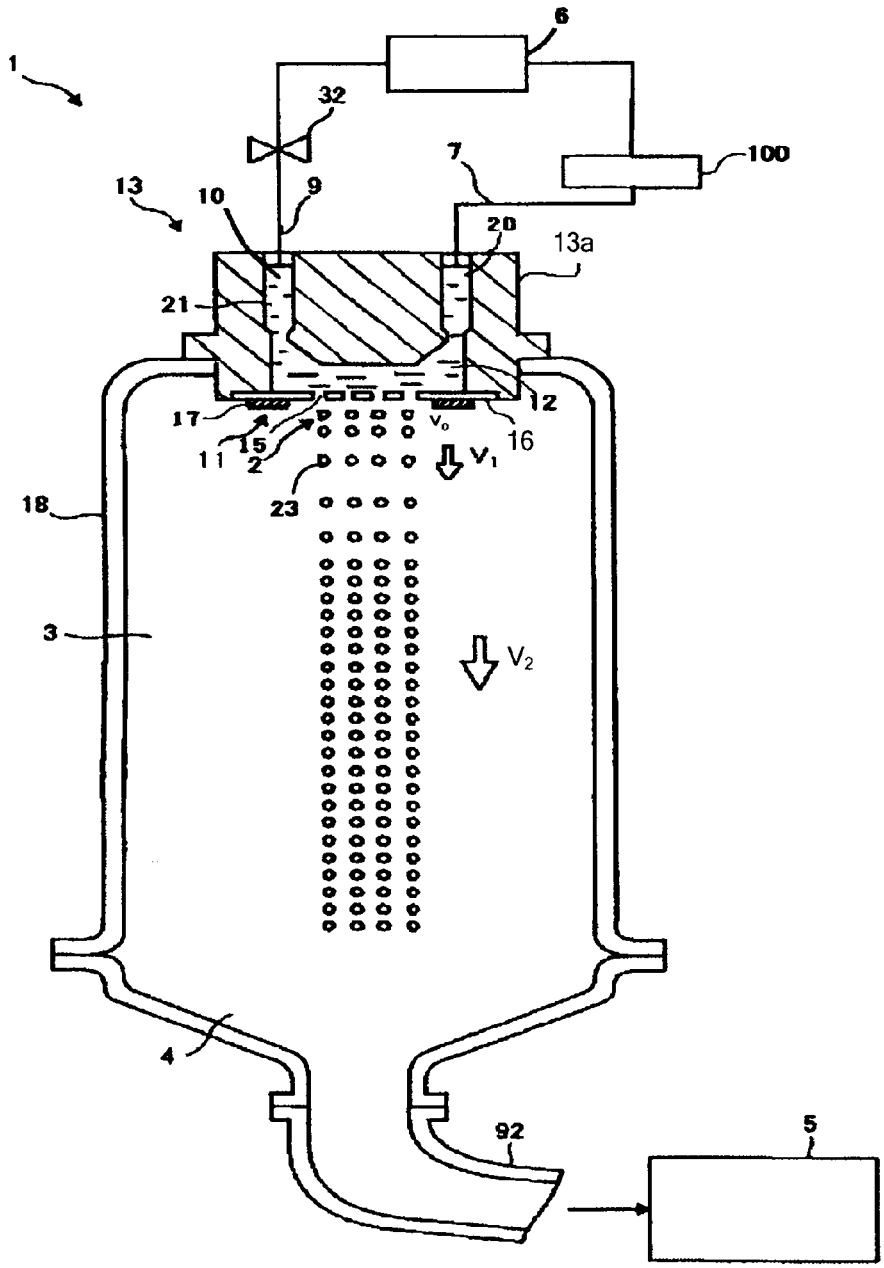
FIG. 1 is a diagram illustrating an entire structure of a device for a toner production method of the related art.

As shown in FIG. 1, the liquid toner composition temporally stored in a raw material housing unit 6 is passed through the liquid supplying hole 20 to the container 13, via a liquid conveying pipe 7 by means of a pump 100, and the excess liquid toner composition is passed through a valve 32 via a liquid discharging pipe 9, which connects with the discharging hole 21 at one end and connects with the valve 32 so as to control the flow of the liquid toner composition, and send back to the raw material housing unit 6. The pressure inside of the liquid chamber is preferably maintained at a constant level. To this end, the amount of the liquid sending to the liquid chamber is controlled by adjusting the power of the pump and the throttling of the valve 32.

In FIG. 1, the pipes 7 (a liquid conveying pipe) and 9 (a liquid discharging pipe) are illustrated with solid lines for brevity, but are pipes in the real construction.

In this manner, the liquid toner composition is circulated. At the time when the liquid toner composition is jetted (released), the liquid toner composition may be jetted while the liquid toner composition is circulated with the valve 32 opening, or the liquid toner composition may be jetted while the flow of the liquid toner composition is stopped with the valve 32 closed. In the case where the flow of the liquid toner composition is stopped and jetted, once the liquid toner composition is used up in the reservoir 12 of the container 13, the valve 32 is opened so as to supply the liquid toner composition.

The container 13 is formed by circularly counter boring the column member 13*a* of the jetting unit 2, and formed in the form of a room.

The column member 13*a* has a liquid supplying pipe 7 (a liquid conveying pipe) and a discharging pipe 9 (a liquid discharging pipe) each formed upper surface of the unit so that the liquid toner composition 10 is supplied from the liquid supplying pipe 7 (the liquid conveying pipe) and is discharged from the discharging pipe 9 (the liquid discharging pipe). On the bottom surface of the column member 13*a*, an ejecting plate 16 is disposed, and forms the bottom part of the container 13. As shown in FIG. 1, as the ejecting plate 16, an ejecting plate is used, and a plurality of nozzles piecing through the ejecting plate are disposed in a center portion of the ejecting plate. As shown in this example, the head of the droplet jetting unit is consisted of the ejecting plate 16 having a plurality of the nozzles 15 and an ejecting plate vibrating unit 17 which is bonded to the outer face of the ejecting plate 16 in the form of a concentric circle.

Once a driving voltage is applied to the ejecting platen vibrating unit 17 from the driving device which is not shown in the drawing, the ejecting plate vibrating unit 17 vibrates and along with the vibration of the ejecting plate vibrating unit 17, the ejecting plate vibrates.

In this case, as a plurality of the nozzles are formed in the center portion of the ejecting plate 16, the ejecting plate 16 vibrates along with the vibration of the ejecting plate vibrating unit 17, while deforming the center portion thereof so as to be projected or dented while the outer periphery of the ejecting plate was fixed. As a result, the toner material liquid retained in the liquid chamber is released from the nozzles 15 in the form of droplets 23. The initial velocity of the droplets 23 at this time is determined as $v_0$. The jetted droplets form the group of a toner (a flow of a toner) consisted of droplets.

At this time, assuming that there is no transporting air flow in the chamber, the droplets having the initial velocity $v_0$ as a result of the jetting reaches a flow velocity $v_1$ by receiving the viscous resistance of the air in the chamber as shown in FIG. 1, and eventually reaches an end velocity $v_2$ as a result of the force of free falling with the viscous resistance.

The particle forming part 3 in which the droplets 23 of the liquid toner composition 10 are solidified to form toner particles T will be explained.

Here, as mentioned earlier, the solution or dispersion in which the toner composition containing at least a resin and a colorant is dissolved or dispersed in a solvent is used as the liquid toner composition 10, the toner particles T are formed by drying and solidifying the droplets 23. In other words, in this embodiment, the particle forming part 3 is a solvent removing part in which the solvent of the droplets 23 is dried and removed (hereinafter, the particle forming part 3 may also be referred as "a solvent removing part" or "a drying part").

In this embodiment, as the means for solidifying the droplets formed of the liquid toner composition 10 that is the solution or dispersion in which the toner composition containing at least a resin and a colorant is dissolved or dispersed, the solvent removing part (the atomizing means) is used, and in the solvent removing part the organic solvent contained in the droplets is evaporated into a dry gas. The toner particles are formed by preceding contraction-solidification due to drying. However, the aforementioned means is not limited to such the example.

In the case of the aforementioned embodiment, there has been a problem such that the jetting performance is lowered as the device is used for the longer period. The reason thereof is considered to be an occurrence of the clogging of the pores (nozzles) due to the change is the dispersion state of the solid contends of the liquid toner composition. According to the embodiment of FIG. 1, the device has a structure such that the liquid toner composition is circulated between the raw material storing unit 6 and the droplet ejecting unit 2.

Since the liquid toner composition contains the solid contents therein, the solid contents are gradually aggregated as a result of the circulation over a long period. When the size of the aggregate becomes significantly large compared to the nozzle system, the nozzles starts to be clogged and as a result, the jetting performance is lowered.

[First Embodiment of the Present Invention]

Figure 2:
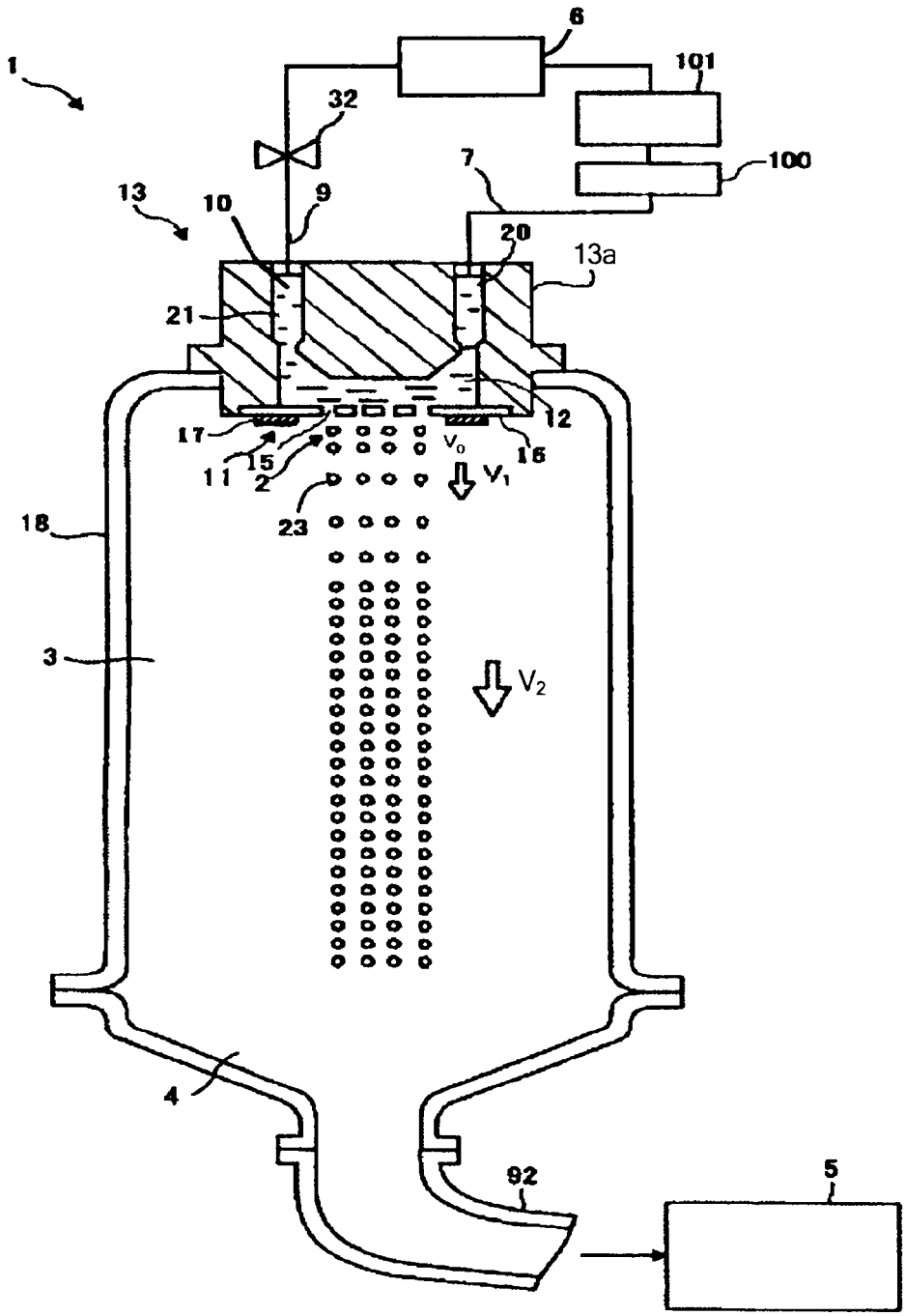
FIG. 2 is a diagram illustrating an entire structure of a device for a method for producing a toner of the present invention.

One of the key points of the present invention is, as shown in FIG. 2, to provide the vibration room 101 inline just before the liquid chamber. Note that, FIG. 2 illustrates the same structure to that of FIG. 1, expect that it is equipped with the ultrasonic room 101. In order to aggregations of the solid contents contained in the liquid toner composition, the means for re-dispersing the solid contents is necessary. Specifically, by ultrasonic vibrating the liquid toner composition before entering the liquid chamber, the pigment and wax components dispersed in the dispersion as the solid contents are released from their aggregated state, and thus the clogging of the nozzles is prevented over a long period of time. In addition, the gas component contained in the liquid toner composition is removed at the same time as the above, and thus the occurrence of cavitation is also prevented during jetting. Accordingly, the stable jetting performance is maintained to thereby stably obtain the uniform toner.

The production device for realizing the method for producing a toner of present invention contains a liquid chamber (container) 13 configured to temporally retain the material solution having a fluidity, an ejecting plate 16 having a plurality of pores and disposed one surface of the liquid chamber, a vibration applying unit 17 configured to apply mechanical vibration to the ejecting plate, a chamber unit 18 configured to dry and solidify the jetted matters from the ejecting plate, and an guiding pipe 92. This toner production device 1 is equipped with a ultrasonic room 101 just before a pump 100 for sending the liquid toner composition to the liquid chamber, and the liquid toner composition temporally stored in the raw material storing unit 6 is ultrasonic vibrated as it passes through the ultrasonic room 101, to thereby perform dispersion of the dispersed matters and degassing of the liquid toner composition at the same time. As a result of this, the clogging of the nozzles can be prevented over a long period of time. In addition, the occurrence of the cavitation is also prevented, and thus the stable jetting performance is maintained and the uniform toner is stably produced.

The details of the ultrasonic room will be explained with reference to FIG. 3. The ultrasonic room 101 is filled with the liquid toner composition 54, and is equipped with a vibrator 51 at the bottom part thereof. The location of the vibrator may be the bottom part or side part thereof, but is preferably the location where the vibrator can apply the vibration to the liquid toner composition. The vibration frequency transmitted from the vibrator 51 is preferably 10 kHz to 200 kHz, more preferably 20 kHz to 100 kHz. When the frequency or wave form of the vibration is the same as those applied to the vibrating unit 17 at the time of jetting by the jetting device of FIG. 2, the effect for preventing cavitation is large and jetting performance is more stabilized. Moreover, the wave form of the vibration applied to the vibrator may be such that a plurality of frequencies are superimposed.

In the ultrasonic room 101, the gas may be generated from the air substance or solvent present in the liquid toner composition 54 at the time when the liquid toner composition 54 is vibrated. In order to remove the generated gas from the ultrasonic room 101, a vent 53 for removing the generated gas may be disposed at the top portion of the ultrasonic room 101.

Figure 3:
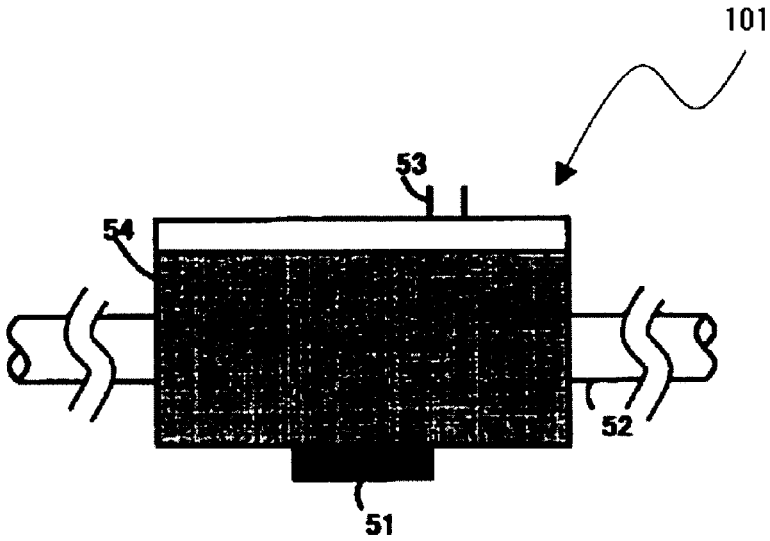
FIG. 3 is a diagram illustrating a construction example of an ultrasonic wave chamber.

In FIG. 3, the reference number 52 denotes a pipe.

The control of the droplet forming conditions including the jetting condition for used in the method for forming a toner of the present invention include controlling of driving conditions such as voltage, frequency and the like applied to the ejecting plate vibrating unit.

Hereinafter, these conditions are briefly explained.

<Control of Applied Voltage>

In the example of FIG. 1, the amplitude of the ejecting plate becomes large and the vibration speed of the ejecting plate becomes fast, as the driving voltage is increased.

Therefore, the larger amount of the liquid toner composition can be jetted. As the driving voltage is lowered, the amount of the liquid toner composition decreases, eventually no liquid toner composition can be jetted. In the case where the driving voltage is increased, it is desirably set within the input capacity of the vibrating unit 17 and is determined also based on the controllability of the ejecting plate 16.

<Control of Applied Frequency>

The frequency of the voltage applied to the vibration applying unit may be controlled, but is preferably in the range of 10 kHz to 2.0 MHz as fine droplets having extremely unformed particle size are formed, more preferably 20 kHz to 200 kHz in view of production efficiency. When the frequency is decreased, the vibration of the ejecting plate 16 tends to become large, and the reverse is occurred when the frequency is increased. As one droplet is formed per cycle of the frequency, the higher frequency means the larger production amount per unit time.

<Details of the Present Embodiment>

The toner production device of the present embodiment contains, as shown in FIG. 2, a chamber 18 having the droplet jetting unit disposed at the upper part thereof and configured to jet and dry the droplets, and an guiding pipe 92 configured to send the toner obtained in the chamber 18 to the toner storage.

In such the toner production device, the droplet jetting unit 2 contains a droplet forming unit 11 configured to form the liquid toner composition 10, in which the toner composition containing at least a resin and a colorant is dissolved or dispersed in an organic solvent, into droplets and then release, and a contained 13 in which a reservoir (liquid flow pass) 12 configured to supply the liquid toner composition 10 to the droplet forming unit 11 is formed.

The ejecting plate 16 is joined and fixed with the bottom surface of the column member 13*a* constituting the side wall of the container 13 by soldering or a resinous binding material that does not dissolve to the liquid toner composition 10, so as to constitute the bottom part of the container 13.

Moreover, the vibration unit 17 in the form of circular ring is also joined and fixed to the ejecting plate 16 by soldering or the resinous binding material that does not dissolve to the liquid toner composition 10. To this vibration unit 17, a driving voltage is applied from the driving circuit via a lead wire or the like, which is not shown in the drawing.

For example, the thin film 16 is formed of a metal plate having a thickness of 5 μm to 500 μm, in which the nozzle pores 15 have a diameter of 3 μm to 35 μm and the number of nozzle pore 15 is in the range 50 to 3,000. The vibration unit 17 is not particularly limited as long as it can surely apply vibration to the thin film 16 at a constant frequency. For example, a bimorph piezoelectric element capable of exciting flexural vibration is preferable.

Examples of the piezoelectric elements include piezoelectric ceramics such as lead zirconium titanate (PZT).

PZT is used in a laminated state because it produces a small amount of deflection. Additionally, examples of the piezoelectric elements include piezoelectric polymers such as polyvinylidene fluoride (PVDF); crystals; and single crystals such as $LiNbO_3$, $LiTaO_3$ and $KNbO_3$.

The liquid supply hole 20 for supplying the reservoir 12 with the toner composition liquid 10, and the discharge hole 21 are respectively connected to the container 13. The droplets 23 are released from the nozzles 15 by means of the droplet forming unit 11.

The vibration frequency of the vibrating unit 17 is, as mentioned earlier, preferably 10 kHz to 2.0 MHz, more preferably 20 kHz to 200 kHz. When the vibration frequency is less than 10 kHz, it is hard to accelerate dispersion of fine particles of a colorant, wax and the like in the toner composition liquid 10 by applying vibration thereto. When the vibration frequency is more than 2.0 MHz or more, it is difficult to stably form droplets.

A voltage is applied to the circular ring vibrating unit 17 from the driving device that is not shown in the diagram to thereby vibrate the vibrating unit 17. The ejection plate 16 is vibrated along with the vibration of the vibrating unit 17. In this case, as the circular ring vibrating unit 17 is disposed at the outer surface of the ejecting plate 16 and the circumference of the nozzle 15 and a plurality of the nozzles 15 are formed in the center portion of the ejecting plate 16, once the voltage having the aforementioned frequency is applied to the vibrating unit 17, the material solution is pushed out from and suctioned into the ejection plate 16 respectively at least once while the circumference of the ejecting plate 16 is in the fixed state. By this, the center portion of the ejecting plate 16 is vibrated while deforming so as to be dented or projected. As a result, the liquid toner composition 10 reserved in the reservoir 12 is formed into droplets 23, and jetted from the nozzles 15 to be released.

The solvent of the released droplets 23 is removed while passing through the particle forming part 3 so as to be solidified, and the solid products are collected in the toner storage 5.

[Second Embodiment of the Present Invention]

Figure 4:
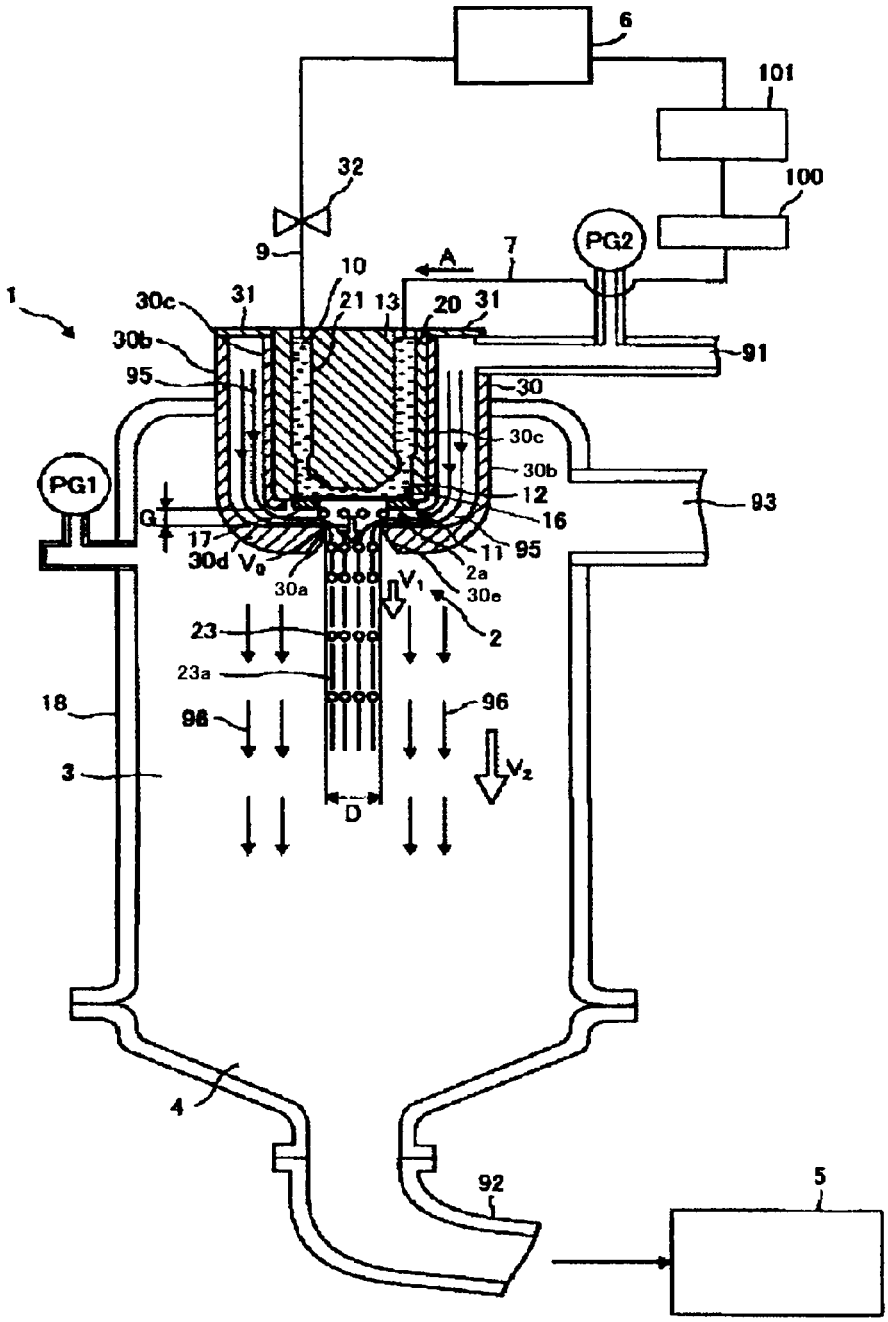
FIG. 4 is a diagram illustrating an entire structure of another device for the method for producing a toner of the present invention.

FIG. 4 is a diagram illustrating the toner production device of the second embodiment for use in the method for producing a toner of the present invention. In the present embodiment, the jetting unit has a shroud (a shell or covering), and has the transporting air flow around the flow of the toner. This transporting air flow is utilized to increase the velocity of the group of the toner ejected is increased, or decrease the velocity thereof in case where the ejection initial velocity is high. As a result, the cohesion of particles caused by crushing the particles together during the drying process which is until the ejected toner is solidified is efficiently prevented, the obtained group of the toner has extremely few numbers of cohered particles, and thus the production efficiency including the yield can be improved.

In the present invention, similar to the production device of the first embodiment, the production device has the chamber 18 having the droplet jetting unit 2 at the upper part of the device and configured to jet and dry the droplets, and the guiding pipe configured to send the toner obtained in the chamber 18 to the toner storage.

The droplet jetting unit 2 contains a droplet forming unit 11 configured to release the liquid toner composition 10, in which the toner composition containing at least a resin and a colorant is dissolved or dispersed in the organic solvent, as droplets, and a container 13 in which a reservoir (liquid flow pass) 12 for supplying the liquid toner composition 10 to the droplet forming unit 11 is formed.

The droplet forming unit 11 is the same as in the first embodiment. The parts different from the first embodiment will be explained hereinafter.

To the container 13 of the toner, the liquid supplying hole 20 for supplying the liquid toner composition (material solution) 10 to the reservoir 12 and the discharging hole 21 are respectively connected. The droplets 23 are released from the nozzles 15 by the droplet forming unit 11.

Then, at the outer side of the container 13, the shroud 30 having an opening 30*a* which faces the nozzles 15 is arranged, which forms a flow passage for gas which transports the droplets 23 flowing along an ejection direction of the liquid toner composition 10 from the nozzles 15. The shroud 30 is formed of pot-shaped double walls 30*b*, 30*c*, which are connected together with a lid 31. In the side surface of the shroud 30, a blowoff pipe 91 for blowing gas off is airtightly inserted. Of the double walls, the inner wall 30*c* extends to near the lower end of the container 13, and the outer wall 30*b* has inwardly rounded shape and extends to the position under the nozzles 15 so as to have the circular opening 30*a* which faces the nozzles 15. The diameter of the opening 30*a* is represented by "D". The inner surface of a bottom 30*d* of the outer wall 30*b* and the lower end of the nozzles 15 maintain a clearance "G". The size of G is smaller than that of D. Thus, G is a main factor for deciding the flow velocity of the transport air flow.

The circulation system for the liquid toner composition disposed at the top part of the droplet forming unit 11 is the same as in FIGS. 1 and 2.

The flow 23*a* including the droplet 23 is guided into the space between the bottom surface of the container 13 and the opening 30*a* of the wall 30*b* of the shroud 30. In the chamber 18, an downstream air flow 96 shown in FIG. 4 is formed from the blowing inlet 93 of the chamber mentioned later. This air flow 96 is a uniform laminar flow, and the flow 23*a* including the droplets 23 is dried and solidified by the air flow 96 in the state of the laminar flow, and guided to a guiding pipe 92 connected with the toner collecting part 4 located at the bottom. The guiding pipe 92 is connected to a cyclone (not shown) in which the droplets are collected while further dried, and then transported to the toner storage 5. At the side surface of the upper part of the shroud 30, a blowoff pipe 91 for blowing gas off is airtightly inserted. On the other side surface of the chamber 18, a pressure gage PG1 is inserted. Moreover, a pressure gage PG2 is inserted to the side surface of the blowoff pipe of the shroud 30.

In the present invention, as shown in FIG. 4, the ultrasonic room 101 is disposed at the location before the pump 100 for sending the liquid toner composition to the liquid chamber. The liquid toner composition temporally stored in the raw material storing unit 6 is ultrasonic vibrated as it passes through the ultrasonic room 101, to thereby perform dispersion of the dispersed matters and degassing of the liquid toner composition at the same time. As a result of this, the clogging of the nozzles can be prevented over a long period of time. In addition, the occurrence of the cavitation is also prevented, and thus the stable jetting performance is maintained and the uniform toner is stably produced.

Next, the operation of the toner production device for use in the present embodiment will be explained. Here, the case where the liquid toner composition 10 is circulated will be explained. Once a circular ring vibrating unit 17 that is a vibrating unit is driven and vibrated, for example, at 100 kHz by a driving device that is not shown in the drawing, while the liquid toner composition 10 is stored in the contained 13 under the appropriate pressure, the vibration is transmitted to the ejecting plate 16, to thereby release the liquid toner composition 10 from a plurality of the nozzles 15 at the releasing frequency matched to the frequency of the vibration in the form of the droplets 23. The initial velocity $v_0$ of the droplets 23 tends to decreased by receiving the viscous resistance of the gas in the shroud 30.

Into the shroud 30, the gas is blown from the blowoff pipe 91, and passed through the shroud 30 to thereby form a transporting air flow 95 and released from the opening 30*a* into the chamber 18. The formed transporting air flow 95 is uniformly flown downwards in the circumferential direction, and then changed the flow smoothly in the lateral direction at the rounded lower end of the wall 30*b* of the shroud 30. Then the transporting air flow 95 traveled through the shroud 30 is merged together under the nozzles 15 and is discharged from the opening 30*a*. At this time, a turbulent flow tends to cause the cohesion of the droplets 23, the air flow is preferably a laminar flow.

The released droplets 23 are entrapped in the transporting air flow 95 and released from the opening 30*a* into the chamber 18, and then entrapped in the air flow 96, and sent to the toner collecting part 4 without cohering to each other.

In this embodiment, the flow velocity $v_1$ of the transporting air flow 95 is faster than the initial velocity $v_0$ of the droplets 23, and the embodiment shows the case that, after the speed of the droplets 23 are accelerated, the droplets 23 entrapped in the transporting air flow 95 and then sent. $v_1$ is acceptable if it is faster than the free falling speed, and may be slower than the initial velocity $v_0$. In the chamber, the air flow 96 having the flow velocity $v_2$ faster than $v_1$ is formed. The faster flow velocity $v_2$ of the air flow 96 is more preferable in view of the prevention of the cohesions. The air flow 96 in the chamber 18 forms a uniform air flow in the circumferential direction by blowing the air off from the blowing inlet 93 of the chamber, similarly to the case in the shroud 30. In the chamber 18, the air flow is preferably a laminar flow. The relationship between the flow velocity $v_1$ of the flow 23*a* of the droplets 23 and the flow velocity $v_2$ of the air flow 96 in the chamber 18 is preferably $v_2 \geqq v_1$, and when these flow velocities satisfies the aforementioned relationship, the flow 23*a* (having the flow velocity of $v_1$) of the droplets including the droplets 23 just after released into the chamber 18 does not form turbulence and flow down smoothly.

The flow velocities of the transporting air flow 95 in the shroud 30 and the air flow 96 in the chamber 18 are managed by the pressure gauges PG1 and PG2. The pressure $P_1$ inside the shroud 30 and the pressure $P_2$ inside the chamber 18 preferably satisfy the relationship of $P_1 \geqq P_2$. When these pressures do not satisfy the aforementioned relationship, a negative pressure is applied to the droplets 23 and the droplets may be reversely flown back.

As mentioned earlier, the rate-limiting factor for determining the flow velocity of the transporting air flow 95 of the shroud 30 is G, namely the clearance between the wall 30*b* and the head 2*a*, because of the relationship D>G.

In this way, both the transporting air flow 95 in the shroud 30 and the air flow 96 in the chamber 18 are respectively formed by blowing gas from the blowoff pipe 91 located above the chamber 18, and from the blowoff pipe 93 located in the chamber 18. However, air flow can be formed by suctioning the internal air from the pipe 92 arranged at the bottom of the chamber 18.

The cross-section of the diameter of the opening 30*a* of the wall 30*b* of the shroud 30 increases along the direction for discharging gas. That is, a taper 30*e* is arranged so that its diameter increases with distance from the opening 30*a*. The taper 30*e* formed in the opening 30*a* can prevent the droplets 23 from being in contact with and adhering to the surface of the opening 30*a*, when the droplets 23 pass through the opening 30*a*.

In the present embodiment, nitrogen gas is used for blowing in the shroud 30 and the chamber 18 as the blowing gas, but is not limited thereto as long as it is a gas. The blowing gas may be air or other gas. Moreover, in FIG. 4, the shroud 30 is formed of pot-shaped double walls, but the outer wall constituting the container 13 may be used as the inner wall 30*c*. Moreover, the production efficiency of the toner can be further improved by providing the structure such that a plurality of the droplets jetting units 2 and the shrouds 30 are disposed in one chamber 18.

The solvent of the released droplets 23 is removed as the droplets 23 passes through the particle forming part 3, and then the droplets are solidified and collected in the toner storage 5.

In FIG. 4, "A" denotes the direction that the liquid toner composition travels.

Figure 5:
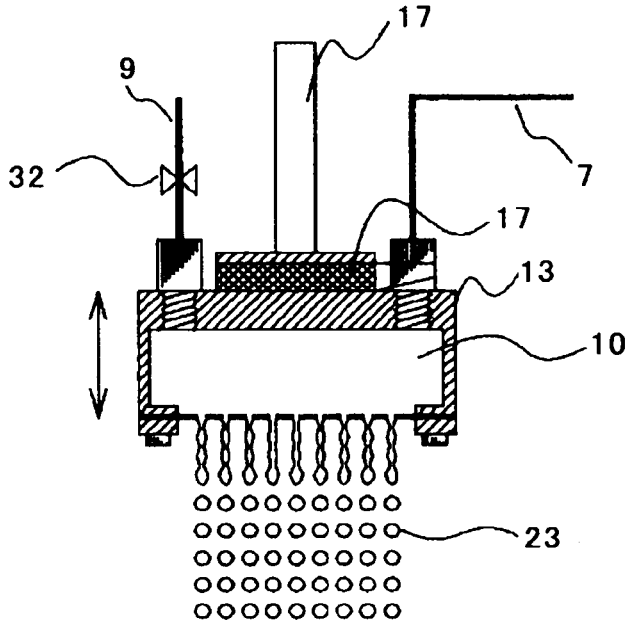
FIG. 5 is a diagram illustrating a partial structure of another device for the method for producing a toner of the present invention.

FIGS. 1, 3 and 4 show the embodiments in which the vibrating unit is disposed outer side of the ejecting plate, but as shown in FIG. 5, the vibrating unit 17 may be disposed at the side facing to the ejecting plate of the liquid chamber 13 so as to be in contact with the liquid chamber 13 so that the material solution 10 is vibrated by the liquid vibration unit to push the material solution 10 and then to suction the same repeatedly to thereby eject droplets 23.

Next, the toner of the present invention will be explained. The toner of the present invention is a toner produced by the aforementioned method for producing a toner. Since the toner of the present invention is produced by the method for producing a toner of the present invention, the toner has monodispersibility in its particle size distribution.

Specifically, the particle size distribution (mass average particle diameter/number average particle diameter) of the toner is preferably in the range of 1.00 to 1.15, more preferably in the range of 1.00 to 1.05. Moreover, the mass average particle diameter of the toner is preferably in the range of 1 μm to 20 μm, more preferably in the range of 3 μm to 10 μm.

Next, the toner material (liquid toner composition) for use in the present invention will be explained. First of all, the liquid toner composition in which the toner composition is made dispersed or dissolved in a solvent will be explained.

As for the toner material, the same material to those for the conventional toner for electrophotography can be used. Specifically, a toner binder such as styrene-acryl resin, polyester resin, polyol resin, and epoxy resin, is made dissolved in various organic solvents; a colorant is dispersed therein as well as that a releasing agent is dispersed or made dissolved therein; the mixture is formed into fine droplets and then dried by the method for producing a toner, to thereby produce intended toner particles. Moreover, it is also possible to obtain the intended toner by heat-melting and kneading the aforementioned material so as to obtain the kneaded product, dissolving or dispersing the kneaded product in a various solvent to prepare a solution, and forming fine droplets from the solution and drying the same to solidify in accordance with the method for producing a toner.

[Toner Material]

The toner material contains at least a resin and a colorant, and may further contain other components such as carrier, and wax, as necessary.

[Resin]

Examples of the resin include at least a binder resin.

The binder resin is suitably selected from the generally used resins in the art without any restriction. Examples thereof include: vinyl polymer formed of styrene monomers, acryl monomers, methacryl monomers or the like, and copolymers of these monomers or a combination of two or more thereof; polyester polymer; a polyol resin; a phenol resin; a silicone resin; a polyurethane resin; a polyamide resin; a furan resin; an epoxy resin; a xylene resin; a terpene resin; a coumarone-indene resin; a polycarbonate resin; and a petroleum resin.

Examples of the styrene monomer include: styrenes such as styrene, o-methyl styrene, m-methyl styrene, p-methyl styrene, p-phenyl styrene, p-ethyl styrene, 2,4-dimethyl styrene, p-n-amyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-dichlorostyrene, m-nitro styrene, o-nitro styrene, and p-nitro styrene; and derivatives thereof.

Examples of the acryl monomer include: acrylic acids such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate; and esters thereof.

Examples of the methacryl monomer include: methacrylic acids such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate; and esters thereof.

Examples of other monomers for forming the vinyl polymer or copolymer include the following (1) to (18);

(1) monoolefines, such as ethylene, propylene, butylene, and isobutylene;
(2) polyenes, such as butadiene, and isoprene;
(3) halogenated vinyls, such as vinyl chloride, vinylidene chloride, vinyl bromide, and vinyl fluoride;
(4) vinyl esters, such as vinyl acetate, vinyl propionate, and vinyl benzonate;
(5) vinyl ethers, such as vinyl methyl ether, vinyl ethyl ether, and vinyl isobutyl ether;
(6) vinyl ketones, such as vinyl methyl ketone, vinyl hexyl ketone, methyl isopropenyl ketone;
(7) N-vinyl compounds, such as N-vinyl pyrrole, N-vinyl carbazole, N-vinyl indole, and N-vinyl pyrrolidone;
(8) vinyl naphthalenes;
(9) derivatives of acrylic acid or methacrylic acid, such as acrylonitrile, methacrylonitrile, and acrylamide;
(10) unsaturated dihydric acid, such as maleic acid, citraconic acid, itaconic acid, alkenyl succinic acid, fumaric acid, and mesaconic acid;
(11) unsaturated dihydric anhydrides, such as maleic anhydride, citraconic anhydride, itaconic anhydride, akkenyl succinic anhydride;
(12) monoesters of unsaturated dihydric acids, such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate, and monomethyl mesaconate;

(13) esters of unsaturated dihydric acid, such as dimethyl maleate, and dimethyl fumarate;

(14) α,β-unsaturated acids, such as crotonic acid, and cinnamic acid;

(15) α,β-unsaturated acid anhydrides, such as crotonic anhydride, and cinnamic anhydride;

(16) monomers each having a carboxyl group, such as anhydride of α,β-unsaturated acid and lower fatty acid, alkenyl malonic acid, alkenyl glutaric acid, alkenyl adipic acid, anhydrides of these acids, and monoesters of these acids;

(17) hydroxyalkyl esters of acrylic acid or mathacrylic acid such as 2-hydroxyethyl acrylate, 2-hydroxyethyl methacrylate, and 2-hydroxypropyl methacrylate; and

(18) monomers each having a hydroxyl group, such as 4-(1-hydroxy-1-methylbutyl)styrene, and 4-(1-hydroxy-1-methylhexyl)styrene.

The vinyl polymer or copolymer for use as the binder resin in the toner of the present invention may have a crosslinked structure which is crosslinked by a crosslinking agent having two or more vinyl groups. Examples of the crosslinking agent for use in this case include: aromatic divinyl compounds such as divinyl benzene, and divinyl naphthalene; di(meth)acrylate compound bonded with alkyl chain, such as ethylene glycol(meth)acrylate, 1,3-butylene glycol(meth)acrylate, 1,4-butanediol(meth)acrylate, 1,5-pentanediol(meth)acrylate, 1,6-hexanediol(meth)diacrylate, and neopentyl glycol (meth)acrylate; and di(meth)acrylate compound bonded with alkyl chain including ether bond, such as diethylene glycol di(meth)acrylate, triethylene glycol di(meth)acrylate, tetraethylene glycol di(meth)acrylate, polyethylene glycol #400 di(meth)acrylate, polyethylene glycol #600 di(meth)acrylate, and dipropylene glycol di(meth)acrylate. Other than those mentioned above, a diacrylate compound and dimethacrylate compound each bonded by a chain containing an aromatic group and an ether bond are also listed as examples. Examples of the polyester diacryaltes include MANDA (product name) manufactured by NIPPON KAYAKU Co., Ltd.

Examples of the polyfunctional crosslinking agent include pentaerythritol tri(meth)acrylate, trimethylolethane tri(meth) acrylate, trimethylolpropane tri(meth)acrylate, tetramethylolmethane tetra(meth)acrylate, oligoester(meth)acrylate, triallyl cyanurate, and triallyl trimellitate.

These crosslinking agent is preferably used in an amount of 0.01 parts by mass to 10 parts by mass, more preferably 0.03 parts by mass to 5 parts by mass with respect to 100 parts by mass of other monomer components. Among these crosslinking monomers, the aromatic divinyl compound (especially, divinyl benzene) and the diacrylate compounds each bonded by the linking chain containing an aromatic group and one ether bond are preferable in view of fixability and antioffset properties of the resin for the toner. Among them, such the combination of the monomers that attains styrene copolymer or styrene-acryl copolymer is preferable.

Examples of the polymerization initiator for use in the production of vinyl polymer or copolymer include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides such as methylethylketone peroxide, acetyl acetone peroxide, and cyclohexanone peroxide, 2,2-bis(tert-butylperoxy)butane, tert-butylhydroperoxide, cumene hydroperoxide, 1,1,3,3-tetramethylbutyl hydroperoxide, di-tert-butyl peroxide, tert-butylcumyl peroxide, di-cumyl peroxide, aqtert-butylperoxy)isopropyl benzene, isobutylperoxide, octanoyl peroxide, decanoyl peroxide, lauroyl peroxide, 3,5,5-trimethylhexanoyl peroxide, benzoyl peroxide, m-tolylperoxide, di-isopropylperoxy dicarbonate, di-2-ethylhexylperoxy dicarbonate, di-n-propylperoxy dicarbonate, di-2-ethoxyethylperoxy carbonate, di-ethoxyisopropylperoxy dicarbonate, di(3-methyl-3-methoxybutyl)peroxy carbonate, acetylcyclohexylsulfonyl peroxide, tert-butylperoxy acetate, tert-butylperoxy butylate, tert-butylperoxy-2-ethylhexanoate, tert-butylperoxylaurate, tert-butyloxybenzoate, tert-butylperoxyisopropylcarbonate, di-tert-butylperoxyisophthalate, tert-butylperoxyallyl carbonate, isoamylperoxy-2-ethylhexanoate, di-tert-butylperoxyhexahydroterephthalate, and tert-butylperoxy azelate.

In the case where the binder resin is a styrene-acryl resin, those resins having at least one peak in the molecular weight range of 3,000 to 50,000 (number average molecular weight conversion) and at least one peak in the molecular weight range of 100,000 or more in the GPC molecular weight distribution of the tetrahydrofurane (THF) soluble components in the resin component are preferable in view of fixing ability, offset resistance, and storage stability. Moreover, with respect to the THF soluble component, the binder resin in which 50% to 90% of the THF soluble component in the molecular weight range of 100,000 or less in the molecular weight distribution is preferably, the binder resin having a main peak in the molecular weight range of 5,000 to 30,000 is more preferable, and the binder resin having a main peak in the molecular weight range of 5,000 to 20,000 is yet more preferable.

In the case where the binder resin is a vinyl polymer such as the styrene-acryl resin, such the binder resin preferably has an acid value of 0.1 mgKOH/g to 100 mgKOH/g, more preferably 0.1 mgKOH/g to 70 mgKOH/g, and yet more preferably 0.1 mgKOH/g to 50 mgKOH/g.

Examples of the monomers constituting a polyester-based polymer are as follows. As for the dihydric alcohol substance, for example, ethylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1,3-hexane diol, and diols formed by polymerizing hydrogenated bisphenol A or bisphenol A with cyclic ether such as ethylene oxide, and propylene oxide are listed.

In order to crosslink the polyester resin, it is preferred that tri- or more hydric alcohol be used together with the above.

Examples of the polyhydric alcohol of tri- or more valency include sorbitol, 1,2,3,6-hexane tetrol, 1,4-sorbitan, pentaerythritol such as dipentaerythritol and tripentaerythritol, 1,2,4-butane triol, 1,2,5-pentane triol, glycerol, 2-methyipropane triol, 2-methyl-1,2,4-butane triol, trimethylol ethane, trimethylol propane, and 1,3,5-trihydroxybenzene.

Examples of the acid component for forming the polyester polymer include: benzene dicarboxylic acids such as phthalic acid, isophthalic acid, and terephthalic acid, and anhydrides thereof; alkyl dicarboxylic acids such as succinic acid, adipic acid, sebacic acid, and azelaic acid, and anhydrides thereof; unsaturated dibasic acid such as maleic acid, citraconic acid, itaconic acid, alkenyl succinic acid, fumaric acid, and mesaconic acid; and anhydride of unsaturated dibasic acid such as maleic anhydride, citraconic anhydride, itaconic anhydride, and alkenyl succinic anhydride. Moreover, examples of the polyhydric carboxylic acid component of tri- or more valency include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, EMPOL trimer acid, anhydrides thereof, and partial lower alkyl ester thereof.

In the case where the binder resin is polyester based resin, it is preferred that at least one peak is present in the molecular weight range of 3,000 to 50,000 in the molecular weight distribution of the THF soluble component of the resin component, in view of the fixing ability of the toner and the offset resistance. Moreover, with respect to the THF soluble component, the binder resin in which the component having the molecular weight of 100,000 or less occupies 60% to 100% is preferable, and the binder resin having at least one peak in the molecular weight range of 5,000 to 20,000 is more preferable.

In the case where the binder resin is a polyester based resin, the acid value thereof is preferably 0.1 mgKOH/g to 100 mgKOH/g, more preferably 0.1 mgKOH/g to 70 mgKOH/g, yet more preferably 0.1 mgKOH/g to 50 mgKOH/g.

In the present invention, the molecular weight distribution of the binder resin is measured by gel permeation chromatography (GPC) using THF as a solvent.

The binder resin usable for the toner of the present invention includes a resin in which a monomer component reactive with the vinyl polymer component and the polyester based resin component is contained in at least either of the vinyl polymer component and the polyester based resin component. Examples of the monomers constituting the polyester based resin component and reactive with the vinyl polymer include unsaturated dicarboxylic acid such as phthalic acid, maleic acid, citraconic acid, and itaconic acid, and anhydrides thereof. Examples of the monomers constituting the vinyl polymer component include those having carboxylic group or hydroxyl group, esters of acrylic acid and methacrylic acid.

Moreover, in the case where the polyester based polymer and/or vinyl polymer is used in combination with other binder resins, 60% by mass or higher of the mixed binder resin preferably have an acid value of 0.1 mgKOH/g to 50 mgKOH/g.

In the present invention, the acid value of the binder resin component of the toner composition is measured according to JIS K-0070 as follows:

(1) additives other than a binder resin (polymer component) are removed to prepare a sample, followed by pulverizing, and 0.5 g to 2.0 g of the thus-obtained sample is precisely weighed (Wg); (note that when the acid value of the binder resin is measured using an untreated toner sample, a colorant, a magnetic material, etc. other than the binder resin and crosslinked binder resin are separately measured in advance for their content and acid value; and the acid value of the binder resin is calculated based on the thus-obtained value);

(2) the sample is placed in a 300-mL beaker and dissolved using a liquid mixture of toluene/ethanol (4/1 by volume) (150 mL);

(3) the resultant sample solution and a blank sample are titrated with a 0.1 mol/L solution of KOH in ethanol using a potentiometric titrator; and (4) using the amount (S mL) of the KOH solution consumed for the sample solution and the amount (B mL) of the KOH solution consumed for the blank sample, the acid value of the sample is calculated based on the formula below:

$$\text{Acid value (mgKOH/g)}=[(S-B)\times f\times 5.61]/W$$

where f is a factor of KOH.

The binder resin of the toner and the composition containing the binder resin preferably have a glass transition temperature (Tg) of 35° C. to 80° C., more preferably 40° C. to 75° C. in view of the storage stability of the formed toner. When the glass transition temperature (Tg) is lower than 35° C., the formed toner tends to degrade under high temperature conditions and to involve offset during fixing. When the Tg is higher than 80° C., the formed toner may have degraded fixing property.

Example of the magnetic material for used in the present invention include: (1) magnetic iron oxides (e.g., magnetite, maghemite and ferrite), and iron oxides containing other metal oxides; (2) metals such as iron, cobalt and nickel, and alloys prepared between these metals and metals such as aluminum, cobalt, copper, lead, magnesium, tin, zinc, antimony, beryllium, bismuth, cadmium, calcium, manganese, selenium, titanium, tungsten and vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These may be used independently or in combination. Of these, micropowders of ferrosoferric oxide or $\gamma$-iron sesquioxide are particularly preferred.

Further, magnetic iron oxides (e.g., magnetite, maghemite and ferrite) containing other elements or mixtures thereof can be used. Examples of the other elements include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc and gallium. Of these, magnesium, aluminum, silicon, phosphorus and zirconium are particularly preferred. The other element may be incorporated in the crystal lattice of an iron oxide, may be incorporated into an iron oxide in the form of oxide, or may be present on the surface of an iron oxide in the form of oxide or hydroxide. Preferably, it is contained in the form of oxide.

Incorporation of the other elements into the target particles can be performed as follows: salts of the other elements are allowed to coexist with the iron oxide during formation of a magnetic material, and then the pH of the reaction system is appropriately adjusted. Alternatively, after formation of magnetic particles, the pH of the reaction system may be adjusted with or without salts of the other elements, to thereby precipitate these elements on the surface of the particles.

The amount of the magnetic material used is preferably 10 parts by mass to 200 parts by mass, more preferably 20 parts by mass to 150 parts by mass with respect to 100 parts by mass of the binder resins. The number average particle diameter of the magnetic material is preferably 0.1 μm to 2 μm, more preferably 0.1 μm to 0.5 μm. The number average particle diameter of the magnetic material can be measured by observing a magnified photograph thereof obtained through transmission electron microscopy using a digitizer or the like.

For magnetic properties of the magnetic material under application of 10 kOersted, it is preferably to use a magnetic material having an anti-magnetic force of 20 Oersted to 150 Oersted, a saturation magnetization of 50 emu/g to 200 emu/g, and a residual magnetization of 2 emu/g to 20 emu/g.

The magnetic material can also be used as a colorant.

<Colorant>

The colorant is suitably selected from the commonly used colorants, without any restriction. Examples of the colorant include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone, and mixtures thereof.

The amount of the colorant is preferably 1% by mass to 15% by mass, more preferably 3% by mass to 10% by mass with respect to the total mass of the toner.

The colorant for used in the toner of the present invention may be used in the form of a masterbatch by mixing the colorant with a resin. Examples of the binder resin which is used for the production of a masterbatch or is kneaded together with a masterbatch include: the aforementioned modified and unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used independently or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

The amount of the masterbatch used is preferably 0.1 parts by mass to 20 parts by mass with respect to 100 parts by mass of the binder resin.

The resin used for forming the masterbatch preferably has an acid value of 30 mgKOH/g or lower and amine value of 1 to 100, more preferably has an acid value of 20 mgKOH/g or lower and amine value of 10 to 50. In use, a colorant is preferably dispersed in the resin. When the acid value is higher than 30 mgKOH/g, chargeability degrades at high humidity and the pigment is insufficiently dispersed. Meanwhile, when the amine value is lower than 1 or higher than 100, the pigment may also be insufficiently dispersed. Notably, the acid value can be measured according to JIS K0070, and the amine value can be measured according to JIS K7237.

Also, a dispersant used preferably has higher compatibility with the binder resin from the viewpoint of attaining desired dispersibility of the pigment. Specific examples of commercially available products thereof include "AJISPER PB821," AJISPER PB822" (these products are of Ajinomoto Fin-Techno Co., Inc.), "Disperbyk-2001" (product of BYK-chemie Co.) and "EFKA-4010" (product of EFKA Co.).

The dispersant is preferably incorporated into the toner in an amount of 0.1% by mass to 10% by mass with respect to the colorant. When the amount is less than 0.1% by mass, the pigment is insufficiently dispersed. Whereas when the amount is more than 10% by mass, chargeability degrades at high humidity.

The dispersant preferably has a weight average molecular weight as measured through gel permeation chromatography of 500 to 100,000, more preferably 3,000 to 100,000, particularly preferably 5,000 to 50,000, most preferably 5,000 to 30,000, from the viewpoint of attaining desired dispersibility of the pigment, wherein the mass average molecular weight is a maximum molecular weight as converted to styrene on a main peak. When the mass average molecular weight is lower than 500, the dispersant has high polarity, potentially degrading dispersibility of the colorant. Whereas when the mass average molecular weight is higher than 100,000, the dispersant has high affinity to a solvent, potentially degrading dispersibility of the colorant.

The amount of the dispersant used is preferably 1 part by mass to 200 parts by mass, more preferably 5 parts by mass to 80 parts by mass, with respect to 100 parts by mass of the colorant. When the amount is less than 1 part by mass, dispersibility may degrade; whereas when the amount is more than 200 parts by mass, chargeability may degrade.

[Other Components]

<Carrier>

The toner of the present invention may be used as a two-component developer by mixing with a carrier. As to the carrier, typically used carrier such as ferrite and magnetite and resin-coated carrier can be used.

The resin-coated carrier is composed of a coating agent containing carrier core particles and a resin covering surfaces of the carrier core particles.

Preferable examples of the resin used as the coating agent include: styrene-acryl resin such as styrene-acrylic ester copolymer, and styrene-methacrylic ester copolymer; acryl resin such as acrylic ester copolymer, and methacrylic ester copolymer; fluorine-containing resin such as polytetrafluoroethylene, monochlorotrifluoroethylene polymer, and polyvinylidene difluoride; silicone resin; polyester resin; polyamide resin; polyvinyl butyral; and amino acrylate. Other than the examples mentioned above, ionomer resin, and polyphenylene sulfide resin are used as a coating agent of the carrier. These resins may be used independently or in combination. Moreover, a binder type of a carrier core in which a magnetic material is dispersed in a resin can be also used.

As a method of covering the surface of a carrier core with at least a resin-coating agent in the resin-coated carrier, the following methods can be used: a method in which a resin is dissolved or suspended to prepare a coating solution, and the coating solution is applied over a surface of the carrier core so as to be adhered thereon; or a method of mixing a resin in a state of powder, simply.

The mixing ratio of the coating agent to the resin-coated carrier may be suitably selected in accordance with the intended use. For example, it is preferably 0.01% by mass to 5% by mass, and more preferably 0.1% by mass to 1% by mass with respect to the resin coated carrier.

For usage examples of coating a magnetic material with two or more types of coating agent, the following are exemplified: (1) coating a magnetic material with 12 parts by mass of a mixture prepared using dimethyldichlorosilane and dimethyl silicon oil based on 100 parts by mass of titanium oxide powder at a mass ratio of 1:5; and (2) coating a magnetic material with 20 parts by mass of a mixture prepared using dimethyldichlorosilane and dimethyl silicon oil based on 100 parts by mass of silica powder at a mass ratio of 1:5.

Among the resins mentioned above, styrene-methacrylic ester copolymer, a mixture of the fluorine-containing resin and styrene-based copolymer, and the silicone resin are preferable, and the silicone resin is particularly preferable.

Examples of the mixture of the fluorine-containing resin and the styrene-based copolymer include a mixture of polyvinylidene difluoride and styrene-methyl methacrylate copolymer, a mixture of polytetrafluoroethylene and a styrene-methyl methacrylate copolymer, and a mixture of vinylidene fluoride-tetrafluoroethylene copolymer (copolymerization mass ratio=10:90 to 90:10), styrene-2-ethylhexyl acrylate copolymer (copolymerization mass ratio=10:90 to 90:10) and styrene-2-ethylhexyl acrylate-methyl methacrylate copolymer (copolymerization mass ratio=20 to 60:5 to 30:10 to 50).

For the silicone resin, modified silicone resins produced by reaction of a nitrogen-containing silicone resin and a nitrogen-containing silane coupling agent with a silicone resin are exemplified.

As the magnetic material for carrier core, it is possible to use ferrite, iron-excessively contained ferrite, magnetite, oxide such as γ-iron oxide; or metal such as iron, cobalt, and nickel or an alloy thereof.

Further, examples of elements contained in these magnetic materials include iron, cobalt, nickel, aluminum, copper, lead, magnesium, tin, zinc, antimony, beryllium, bismuth, calcium, manganese, selenium, titanium, tungsten, and vanadium. Of these elements, copper-zinc-iron-based ferrite containing copper, zinc and iron as main components, and manganese-magnesium-iron-based ferrite containing manganese, magnesium, and iron components as main components are particularly preferable.

For the resistance value of the carrier, it is preferable to adjust the degree of convexo-concave of the carrier surface and the amount of resin used for coating a carrier core so as to be $10^6$ Ω·cm to $10^{10}$ Ω·cm.

The acceptable particle diameter of the carrier is 4 μm to 200 μm, preferably 10 μm to 150 μm, and more preferably 20 μm to 100 μm. Especially, it is preferred that the resin coated carrier has a 50% particle diameter (D50) of 20 μm to 70 μm.

In a two-component developer, the toner of the present invention is preferably used in an amount of 1 part by mass to 200 parts by mass, more preferably 2 parts by mass to 50 parts by mass, with respect to 100 parts by mass of the carrier.

<Wax>

In the present invention, wax can be added together with the binder resin and the colorant.

The wax is not particularly limited and may be suitably selected from among those known in the art in accordance with the intended use. Examples of the wax include: aliphatic hydrocarbon wax such as low-molecular weight polyethylene, low-molecular weight polypropylene, polyolefin wax, microcrystalline wax, paraffin wax, and sazole wax; oxides of aliphatic hydrocarbon wax such as polyethylene oxide wax or block copolymers thereof; vegetable wax such as candelilla wax, carnauba wax, Japan tallow, and jojoba wax; animal wax such as beeswax, lanolin and spermaceti; mineral wax such as ozokerite, ceresin, and petrolatum; wax containing aliphatic ester as main component such as montanoic acid ester wax, and caster wax; and wax in which the aliphatic ester is partly or fully deoxidized, such as deoxidized carnauba wax.

Examples of the wax further include: unsaturated straight-chain fatty acid such as pulmitic acid, stearic acid, montanoic acid, and straight chain alkyl carboxylic acids containing a straight chain alkyl group; unsaturated fatty acid such as brassidic acid, eleostearic acid, and varinaline acid; saturated alcohol such as stearyl alcohol, eicosyl alcohol, behenyl alcohol, carnaubyl alcohol, ceryl alcohol, melissyl alcohol and long-chain alkyl alcohol; polyhydric alcohol such as sorbitol; fatty acid amide such as linoleic acid amide, oleic acid amide, and lauric acid amide; saturated fatty acid bisamide such as methylene bis-capric acid amide, ethylene bis-lauric acid amide, and hexamethylene bis-stearic acid amide; unsaturated fatty acid amide such as ethylene bis-oleic acid amide, hexamethylene bis-oleic acid amide, N,N'-dioleyl adipic acid amide, and N,N'-dioleyl sebacic acid amide; aromatic bisamide such as m-xylene bis-stearic acid amide, and N,N'-distearyl isophthalic acid amide; metal salt of fatty acid, such as calcium stearate, calcium laurate, zinc stearate, and magnesium stearate; wax prepared by grafting a vinyl monomer such as styrene or acrylic acid to an aliphatic hydrocarbon wax; partial ester compound between a fatty acid such as behenic acid monoglyceride and a polyhydric alcohol; and a methyl ester compound containing a hydroxyl group, which is obtained by hydrogenizing a plant oil and fat.

As further preferable examples of the wax, the following are exemplified as such: polyolefin obtained by subjecting an olefin to radical polymerization under a high pressure, polyolefin prepared by purifying a low-molecular weight byproduct obtained at the time of polymerizing a high-molecular weight polyolefin, polyolefin polymerized using a catalyst like Ziegler catalyst and metallocene catalyst under a low pressure, polyolefin polymerized utilizing radiation, electromagnetic wave or light, low-molecular weight polyolefin obtained by thermally decomposing a high-molecular weight polyolefin, paraffin wax, microcrystalline wax, Fisher Tropshe wax, synthetic hydrocarbon wax synthesized by Synthol method, hydrocol method, or Arge method, synthetic wax prepared by using a compound having one carbon atom as monomer, hydrocarbon series wax having a functional group such as hydroxyl group or carboxyl group, a mixture between a hydrocarbon series wax and a hydrocarbon series wax having a functional group, and graft modified wax grafted with a vinyl monomer such as styrene, maleate, acrylate, methacrylate, or maleic anhydride using each of the above-mentioned waxes as a base.

Moreover, the aforementioned wax whose molecular weight distribution is sharpened by a pressure sweating method, a solvent method, a recrystalization method, a vacuum distillation method, a supercritical gas extraction method, or a solution crystallization method, low-molecular weight solid fatty acid, low-molecular weight solid alcohol, a low-molecular weight solid compound, and those removing impurities thereof are also preferably used.

The melting point of the wax is preferably 70° C. to 140° C. for considering a balance between the fixing ability and offset resistance, more preferably 70° C. to 120° C. When the melting point is lower than 70° C., the blocking resistance may be lowered. When the melting point is higher than 140° C., the offset resistance may not be sufficiently exhibited.

Moreover, by using two or more different types of wax in combination, the plasticizing effect and the releasing effect both of which are the functions of the wax can be exhibited at the same time.

Examples of the wax having the plasticizing effect include was having a low melting point, wax having a branched molecular structure, and wax having a structure containing a polar group.

Examples of the was having the releasing effect include wax having a high melting point. The molecular structure of such wax is, for example, a straight chain structure, or a non-polar structure which does not contain a functional group. The usage examples thereof include a combination of two or more types of wax in which the difference in the melting points thereof is 10° C. to 100° C., and a combination of polyolefin and graft-modified polyolefin.

When two types of wax having the similar structures are selected, relatively speaking, the wax having the low melting point exhibits the plasticizing effect, and the wax having the high melting point exhibits the releasing effect. Here, in the case where the difference in the melting points is in the range of 10° C. to 100° C., the functional separation is effectively shown. When the difference is less than 10° C., the functional separation may not be shown clearly. When the difference is more than 100° C., the enhancement of the functions due to the interaction may not be occurred. For the reason such that there is a tendency for exhibiting the functional separation, at least one wax preferably has a melting point of 70° C. to 120° C., more preferably 70° C. to 100° C.

For the wax, relatively, wax having a branched structure, wax having a polar group like functional group or wax modified by a different component from the main component exhibits the plasticizing effect, and wax having a straight chain structure, wax of non-polar type having no functional group or unmodified wax exhibits the releasing effect. Examples of the preferred combination include: a combination of a polyethylene homopolymer or a copolymer containing ethylene as the main component and a polyolefin homopolymer or a copolymer containing olefin other than ethylene as the main component; a combination of polyolefin and a graft-modified polyolefin; a combination of alcohol wax, aliphatic wax or ester wax and hydrocarbon wax; a combination of Fisher Tropshe wax or polyolefin wax with paraffin wax or microcrystal wax; a combination of Fisher Tropshe wax and polyolefin wax; a combination of paraffin wax and microcrystal wax; and a combination of carnauba wax, candelilla wax, rise wax or montan wax, and hydrocarbon wax.

In any of the above combinations, from the perspective that the storage stability and the fixing property of toner are easily kept in balance, in endothermic peaks observed in DSC measurement of the toner, the toner preferably has a peak top temperature of the maximum peak in the range of 70° C. to 110° C., and more preferably has the maximum peak in the range of 70° C. to 110° C.

The total amount of the wax is preferably 0.2 parts by mass to 20 parts by mass, more preferably 0.5 parts by mass to 10 parts by mass with respect to 100 parts by mass of the binder resin.

In the present invention, the temperature of the maximum peak within the endothermic peaks measured by DSC is determined as a melting point of the wax. In the present invention, a peak top temperature of the maximum peak of endothermic peaks of a releasing agent (wax) measured by DSC is to be the melting point of the releasing agent.

In the present invention, as DSC measurement device for the wax or toner, a highly accurate differential scanning calorimeter of inner heat system and of input compensation type is preferably used. The measurement is conducted according to ASTM D3418-82. For the DSC curve used in the present invention, a DSC curve is used which is measured when the temperature of the wax is once raised and then decreased to previously maintain the history records, subsequently, the temperature of the releasing agent is raised at a temperature increasing rate of 10° C./min.

<Flowability Improver>

The flowability improver may be added to the toner of the present invention. The flowability improver is incorporated onto the surface of the toner to improve the flowability thereof.

Examples of the flowability improver include: carbon black; fluorine-based resin powder such as fluorinated vinylidene powder and polytetrafluoroethylene powder; silica powder such as wet-process silica and dry-process silica; titanium oxide powder; alumina powder; surface-treated silica powder, surface-treated titanium oxide and surface-treated alumina each of which is treated with a silane coupling agent, titanium coupling agent or silicone oil. Of these, the silica powder, titanium oxide powder, and alumina powder are preferable. Further, the surface-treated silica powder which is treated with a silane coupling agent or silicone oil is still more preferable.

The particle size of the flowability improver is, as an average primary particle diameter, preferably 0.001 μm to 2 μm, more preferably 0.002 μm to 0.2 μm.

The silica powder is produced by vapor-phase oxidation of a silicon halide compound, is so-called "dry-process silica" or "fumed silica".

As commercially available products of the silica powder produced by vapor-phase oxidation of a silicon halide compound, for example, AEROSIL (trade name, manufactured by Japan AEROSIL Inc.) -130, -300, -380, -TT600, -MOX170, -MOX80 and -COK84; CA-O-SIL (trade name, manufactured by CABOT Corp.) -M-5, -MS-7, -MS-75, -HS-5, -EH-5; Wacker HDK (trade name, manufactured by WACKER-CHEMIE GMBH) -N20 -V15, -N20E, -T30, and -T40; D-C FINE SILICA (trade name, manufactured by Dow Corning Co., Ltd.); and FRANSOL (trade name, manufactured by Fransil Co.).

Further, a hydrophobized silica powder prepared by hydrophobizing a silica powder produced by vapor-phase oxidation of a silicon halide compound is more preferable. It is particularly preferable to use a silica powder that is hydrophobized so that a hydrophobization degree measured by a methanol titration test is preferably from 30% to 80%. A silica powder can be hydrophobilized by being chemically or physically treated with an organic silicon compound reactive to or physically absorbed to the silica powder, or the like. There is a preferred method, in which a silica powder produced by vapor-phase oxidation of a silicon halide compound is hydrophobilized with an organic silicon compound.

Examples of the organic silicon compound include hydroxypropyl trimethoxysilane, phenyl trimethoxysilane, n-hexadecyl trimethoxysilane, n-octadecyl trimethoxysilane, vinyl methoxysilane, vinyl triethoxysilane, vinyl triacetoxysukabem dimethylvinyl chlorosilane, divinyl chlorosilane, γ-methacryloxypropyl trimethoxysilane, hexamethyl disilane, trimethyl silane, trimethyl chlorosilane, dimethyl dichlorosilane, methyl trichlorosilane, allyldimethyl chlorosilane, arylphenyl dichlorosilane, benzyldimethyl chlorosilane, bromomethyldimethyl chlorosilane, α-chloromethyl trichlorosilane, β-chloroethyl trichlorosilane, chloromethyldimethyl chlorosilane, triorganosilyl mercaptan, trimethylsilyl mercaptan, triorganosilyl acrylate, vinyldimethyl acetoxysilane. Dimethyl ethoxysilane, trimethyl ethoxysilane, trimethyl methoxysilane, methyl triethoxysilane, isobutyl trimethoxysilane, dimethyl dimethoxysilane, diphenyl diethoxysilane, hexamethyl disiloxane, 1,3-divinyltetramethyl disiloxane, 1,3-diphenyltetramethyl disiloxane, and dimethyl polysiloxane having 2 to 12 siloxane units per molecule and having 0 to 1 hydroxyl group bonded to Si in the units each present in the terminals thereof. Furthermore, the examples also include silicone oil such as dimethyl silicone oil. There may be used independently or in combination.

The number average particle diameter of the fluidity improving agent is preferably 5 nm to 100 nm, more preferably 5 nm to 50 nm.

The specific surface area of the powder of the flowability improver measured by the BET nitrogen absorption method is preferably 30 $m^2/g$ or more, and more preferably 60 $m^2/g$ to 400 $m^2/g$. In the case of surface treated powder of the flowability improver, the specific surface area is preferably 20 $m^2/g$ or more, and more preferably 40 $m^2/g$ to 300 $m^2/g$.

The use amount of the powder is preferably 0.03 parts by mass to 8 parts by mass with respect to 100 parts by mass of toner particles.

To the toner of the present invention, various metal soaps, fluorosurfactants, dioctyl phthalate, conductive agents (e.g. tin oxide, zinc oxide, carbon black and antimony oxide), and inorganic particles (e.g. titanium oxide, aluminum oxide, and alumina) are optionally added as additives other than those mentioned above, for the purpose of the protection of a latent electrostatic image bearing member or carrier, the improvement of cleaning performance, the adjustment of thermal, electronic or physical characteristics, the adjustment of the resistance, the adjustment of the melting point, the improvement of the fixing rate, and the like. These inorganic particles may be made hydrophobic, as necessary. Moreover, small amounts of a lubricant (e.g. polytetrafluoroethylene, zinc stearate, and polyvinyliene difluoride), abrasives (e.g. cesium oxide, silicon carbide, and strontium titanate), an anti-caking agent, and a developing improver (e.g. white particles and black particles each having reverse polarity to that of the toner particles) may also be used. These additives are preferably treated with a silicone varnish, various silicone varnishes, silicone oil, various type of silicone oil, a silane coupling agent, a silane coupling agent having a functional group, other treating agents such as an organic silicon compound or various treating agent, for the purpose of the control of the charging amount, and the like.

At the time when the developer is prepared, the aforementioned inorganic particles such as hydrophobic silica particles may be added and mixed for enhancing the flowability, storage stability, developing ability and transferring performance of the developer. The additives may be mixed using a conventional mixer for powder which is suitably selected, but the mixer equipped with a jacket or the like, which can adjust the inner temperature is preferably used. In order to change the history of the load applied to the additive, the additives may be added in the middle of the process or may be gradually added. Alternatively, it can be also achieved by changing the rotation number, rolling speed, duration, temperature or the like. Moreover, the heavy load may be applied at first, and then relatively weak lead may be applied, or the reverse thereof may also be performed.

Examples of the mixer used therefore include a V-type mixer, a rocking mixer, LODIGE MIXER, a nauta mixer, and HENSCHEL MIXER.

The method for further adjusting the shape of the obtained toner is suitably selected depending on the intended purpose without any restriction. Examples thereof include a method in which after melt-kneading a toner material containing a binder resin and a colorant, the shape of the finely crushed kneaded product is mechanically adjusted by using a hybridizer, mechanofusion, or the like, a so-called spray-dry method in which after dissolving or dispersing a toner material in a solvent dissolve the toner binder, the solvent is removed by using a spry-dry device to thereby obtain a spherical toner, and a method in which heating is performed in an aqueous medium to thereby make the toner spherical.

As the external additive, inorganic particles are preferably used.

Examples of the inorganic particles include silica, alumina, titanium oxide, barium titanate, magnesium titanate, calcium titanate, strontium titanate, zinc oxide, tin oxide, silica sand, clay, mica, woodstone, silious earth, chromium oxide, cerium oxide, iron red, antimony trioxide, magnesium oxide, zirconium oxide, barium sulfate, barium carbonate, calcium carbonate, silicon carbide, and silicon nitride.

The primary particle diameter of the inorganic particles is preferably 5 nm to 2 μm, more preferably 5 nm to 500 nm.

The specific surface area thereof based on the BET method is preferably 20 $m^2/g$ to 500 $m^2/g$.

The ratio of the inorganic particles to be used is preferably 0.01% by mass to 5% by mass, more preferably 0.01% by mass to 2.0% by mass, relative to the amount of the toner.

Other examples of the external additives include: polymer particles such as polystyrene, and copolymers of metacylic ester or acrylic ester formed by free-soap emulsification polymerization, suspention polymerization, or dispersion polymerization; polymer particles such as silicone, benzoguanamine, or nylon formed by polycondensation; and polymer particles of thermosetting resins.

These external additive enhances its hydrophobic characteristics by a surface treatment, to thereby prevent the same from being degraded in the high humidity environment.

Examples of the surface treating agent include a silane coupling agent, a silanizing agent, a silane coupling agent containing fluoroalkyl group, an organic titanate-based coupling agent, an aluminum-based coupling agent, silicone oil, and modified silicone oil.

The primary particle diameter of the inorganic particles is preferably 5 nm to 2 μm, more preferably 5 nm to 500 nm.

The specific surface area thereof based on the BET method is preferably 20 $m^2/g$ to 500 $m^2/g$.

The ratio of the inorganic particles to be used is preferably 0.01% by mass to 5% by mass, more preferably 0.01% by mass to 2.0% by mass, relative to the amount of the toner.

Examples of the cleaning improver for removing the developer remained on a latent electrostatic image bearing member or primary transferring member after transferring include: metal salt of fatty acid (e.g. stearic acid) such as zinc stearate, and calcium stearate; and polymer particles formed by soapfree emulsification polymerization such as polymethyl methacrylate particles and polystyrene particles. As the polymer particles, those having relatively narrow particle size distribution, and having a volume average particle diameter of 0.01 μm to 1 μm are preferable.

In the developing method using the toner of the present invention, any latent electrostatic image bearing members used for the conventional electrophotography may be used. For example, an organic latent electrostatic image bearing member, an amorphous silica latent electrostatic image bearing member, a selenium latent electrostatic image bearing member, and a zinc oxide latent electrostatic image bearing member can be used.

EXAMPLES

Hereinafter, specific examples according to the aforementioned embodiments will be explained, but these examples shall not be construed as to limit the scope of the present invention.

Example 1

-Preparation of Colorant Dispersion-

At first, a carbon black dispersion was prepared as a colorant.

Specifically, 17 parts of carbon black (REGAL 400, manufactured by Cabot Corp.) and 3 parts of a pigment dispersant were added to 80 parts of ethyl acetate, and primarily dispersed using a mixer having a stirring blade to obtain a primary dispersion liquid. As the pigment dispersant, AJISPER PB821 (manufactured by Ajinomoto Fine-Techno Co., Inc.) was used. The obtained primary dispersion was finely dispersed under strong shearing force using a DYNO MILL to prepare a secondary dispersion in which aggregates having a size of 5 μm or more were completely removed.

-Preparation of Wax Dispersion-

Next, a wax dispersion was prepared.

Specifically, 18 parts of a carnauba wax and 2 parts of a wax dispersant were added to 80 parts of ethyl acetate and primarily dispersed using a mixer having a stirring blade to prepare a primary dispersion. The primary dispersion was heated to 80° C. with stirring to dissolve the carnauba wax therein, and then the temperature of the primary dispersion was decreased to room temperature to precipitate wax particles so as to have a maximum diameter of 3 μm or less. As the wax dispersant, the one prepared by grafting a styrene-butyl acrylate copolymer on a polyethylene wax was used. The obtained dispersion was further finely dispersed under strong shearing force using a DYNO MILL so as to prepare a wax dispersion having a maximum diameter of 1 μm or less.

-Preparation of Toner Composition-

Next, a toner composition dispersion, in which a binder resin, the colorant dispersion and the wax dispersion were added, composed of the following composition was prepared.

Specifically, 100 parts of polyester resin as a binder resin, 30 parts of the colorant dispersion, 30 parts of the wax dispersion, and 840 parts of ethyl acetate were stirred for 10 minutes using a mixer having a stirring blade so as to be uniformly dispersed. The pigment or wax particles were not aggregated by solvent dilution.

-Preparation of Toner-

The obtained dispersion (500 mL) was supplied to the nozzles 15 of the droplet forming unit 11 of the aforementioned toner production device shown in FIG. 2. The ejecting plate (may also referred as "a nozzle plate" hereinafter) 16 for use was prepared in such a manner that ejection pores (nozzles) 15 each having a diameter of 10 μm and in the shape of complete round were formed in a nickel plate having a outer diameter of 15.0 mm and a thickness of 20 μm by electroforming. The ejection pores were arranged in the form of a lattice within the area which was a circle having a diameter of appropriately 5 mm from a center of the ejecting plate 16 so as to have a pitch between each ejection holes of 100 μm. In this case, the number of the effective ejection holes was 1,000 on calculation.

After preparing the dispersion, toner base particles were formed at the following production conditions by ejecting droplets followed drying and solidifying the droplets.

[Toner Production Conditions]

Specific gravity of the dispersion: $\rho$=1.1888 g/cm$^3$
Velocity of the drying air flow: dry nitrogen 5.0 m/s
Temperature inside the device: 27° C. to 28° C.
Dew point temperature: −20° C.
Frequency of the nozzle: 98 kHz
Peak value of a sine wave of the applied voltage: 15.0V
Frequency of the ultrasonic room: 60 kHz
Peak value of a sine wave of the voltage applied to the ultrasonic room: 150 V Note that, "frequency of the nozzle" means the "frequency of the ejecting plate 16". Under such the conditions, the liquid toner composition was stably ejected without causing clogging (blockage) of the nozzles. The ejected amount was 5 g/min. based on the liquid toner composition, and was approximately 0.5 g/min. based on the toner after drying.

The dried and solidified toner particles were subjected to discharging by the exposure of a soft X-ray, and then were suctioned and collected by a filter having pores of 1 μm. After measuring the particle size distribution of the collected particles by a flow particle image analyzer (FPIA-2000) under the following measurement conditions, it was found that toner base particles having a mass average particle diameter (D4) of 5.8 μm, a number average particle diameter (Dn) of 4.9 μm, and D4/Dn of 1.18 were obtained.

A test for ejection stability was carried out, and then it was found that the change of the ejected amount after 48 hours of the operation was 0.5 g/min., and no change was observed from the initial ejected amount.

The measuring method using a flow particle image analyzer will be explained hereinafter. The measurements for the toner, toner particles and external additives by the flow particle image analyzer can be performed, for example, by using a flow particle image analyzer FPIA-2000 manufactured by SYSMEX CORPORATION.

The measurement was carried out in the following manner. After passing through a filter so as to remove fine dusts, to 10 mL of the resulted water in which a number of particles in the measurement range (e.g., a circle equivalent diameter of 0.60 μm or more but less than 159.21 μm) was 20 or less in $10^{-3}$ cm$^3$ of the water, a few drops of a nonionic surfactant (preferably Contaminon N manufactured by Wako Pure Chemical Industries, Ltd.) was added, and 5 mg of a measurement sample was further added thereto. Then, the mixture was dispersed by a ultrasonic homogenizer UH-50 manufactured by STM Co., Ltd. for one minute at 20 kHz and 50 W/10 cm$^3$, and then further dispersed so that the total duration for dispersing be 5 minutes to thereby obtain a sample dispersion in which the concentration of the particles of the measurement sample was 4,000 to 8,000/$10^{-3}$ cm$^3$ (based on the particles in the range of the measuring circle equivalent diameter). Using the sample dispersion, a particle size distribution of the particles having a circle equivalent diameter of 0.60 μm or more but less than 159.21 μm was measured.

The sample dispersion was passed through a flow pass (which gradually widened in the direction of the flow) of a transparent flat flow cell (thickness of about 200 μm). In order to form a light pass passing through the flow cell in the thickness direction thereof, a stroboscope and a CCD camera were arranged so as to face each other with the flow cell being therebetween. The light from the stroboscope is emitted at an interval of 1/30 seconds while the sample dispersion flowed, so as to obtain an image of the particles passing through the flow cell. As a result, each particle was photographed as a two-dimensional image having a certain range parallel to a flow cell. Based on the area of the two-dimensional image of each particle, the diameter of the circle having the same area to the image was determined as a circle equivalent diameter.

Figure 6:
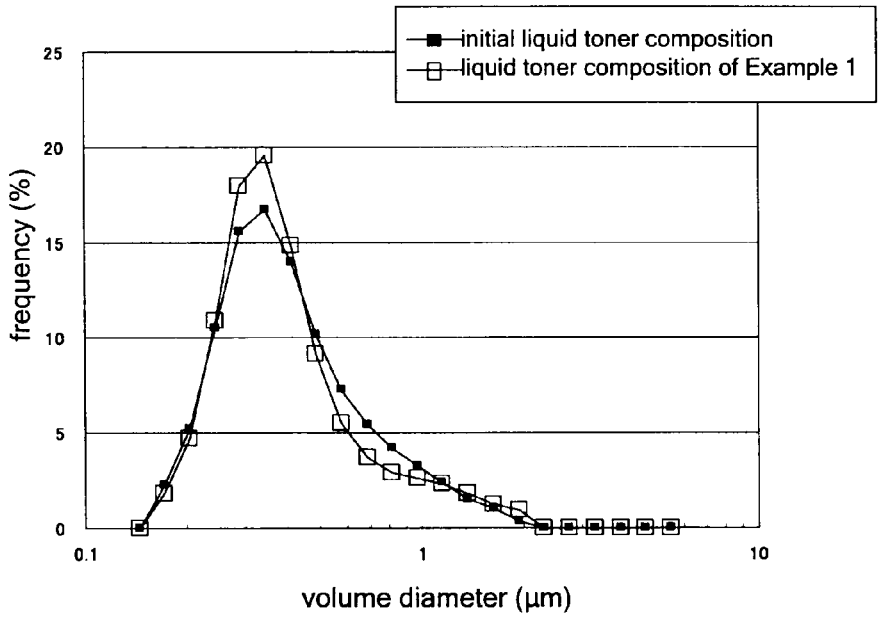
FIG. 6 is a diagram comparing the particle size distribution of the toner formed by using the initial liquid toner composition and that of the toner formed by using the liquid toner composition after ejecting for 48 hours in Example 1.

In about one minute, the circle equivalent diameters of 1,200 or more particles can be measured, and the number based on the distribution of the circle equivalent diameter and a proportion (% by number) of the particles having the specified circle equivalent diameter can be measured. The results (frequency percent and accumulation percent) can be obtained by dividing the range of 0.06 μm to 400 μm into 226 channels (dividing into 30 channels with respect to 1 octave). In the actual measurement, the particles are measured in the circle equivalent diameter range 0.60 μm or more, but less than 159.21 μm. After continuously ejecting for 48 hours, the liquid toner composition was taken out from liquid chamber 13, the solid dispersed matters thereof were subjected to the measurement of the particle diameters. The particle diameters of the solid dispersed matters were measured by Nanotrack NPA150 manufactured by Nikkiso Co., Ltd. This measuring device can measure the particle size distribution of the solid dispersed matters in a liquid by a laser doppler method. The result thereof was compared to the date obtained at the time when the liquid toner composition was prepared (see FIG. 6).

The particle distribution of the solid contents was maintained from the initial state, which complied to the object of the present invention.

Moreover, the particle distribution of the particle collected after the 48 hours continuous operation was measured by a flow particle image analyzer (FPIA-2000), it was confirmed that the toner base particles having the mass average particle diameter (D4) of 5.8 μm, the number average particle diameter of 4.9 μm, and D4/Dn of 1.18 were obtained, and the initial particle size distribution was maintained.

Example 2

The dispersion used in Example 1 was supplied to the nozzles 15 of the droplet forming unit 11 of the aforementioned toner production device shown in FIG. 4, and toner base particles were formed at the following production conditions by ejecting droplets followed drying and solidifying the droplets.

[Toner Production Conditions]

Specific gravity of the dispersion: $\rho$=1.1888 g/cm$^3$
Velocity of the drying air flow: dry nitrogen 5.0 m/s
Temperature inside the device: 27° C. to 28° C.
Dew point temperature: −20° C.
Frequency of the nozzle: 98 kHz
Peak value of a sine wave of the applied voltage: 15.0V
Velocity of shroud air flow: dry nitrogen 20.0 m/s For the first one hour, the liquid toner composition was stably ejected under the aforementioned conditions without causing the clogging (blockage) of the nozzles. The ejected amount was 5 g/min. based on the liquid toner composition, and was approximately 0.5 g/min. based on the toner after drying.

The dried and solidified toner particles were subjected to discharging by the exposure of a soft X-ray, and then were suctioned and collected by a filter having pores of 1 μm. After measuring the particle size distribution of the collected particles by a flow particle image analyzer (FPIA-2000) under the aforementioned measurement conditions, it was found that toner base particles having a mass average particle diameter (D4) of 5.2 μm, a number average particle diameter (Dn) of 4.9 μm, and D4/Dn of 1.06 were obtained.

After continuously ejecting for 48 hours, the liquid toner composition was taken out from liquid chamber 13, and the solid dispersed matters thereof were subjected to the measurement of the particle diameters. The particle diameters of the solid dispersed matters were measured by Nanotrack NPA150 manufactured by Nikkiso Co., Ltd. The particle distribution of the solid contents was maintained the state which hardly changed from the initial state of Example 1, which complied to the object of the present invention.

The toner obtained after the 48 hour continuous operation had a mass average particle diameter (D4) of 5.2 μm, a number average particle diameter (Dn) of 4.9 μm, and D4/Dn of 1.06, and it was confirmed that the initial particle size distribution could be maintained.

Comparative Example 1

The dispersion used in Example 1 was supplied to the nozzles 15 of the droplet forming unit 11 of the aforementioned toner production device shown in FIG. 1, and toner base particles were formed at the following production conditions by ejecting droplets followed drying and solidifying the droplets. Note that, the toner production device used in this comparative example did not have an ultrasonic room that was one of the characteristics of the present invention.

[Toner Production Conditions]

Specific gravity of the dispersion: $\rho$=1.1888 g/cm$^3$
Velocity of the drying air flow: dry nitrogen 5.0 m/s
Temperature inside the device: 27° C. to 28° C.
Dew point temperature: −20° C.
Frequency of the nozzle: 98 kHz
Peak value of a sine wave of the applied voltage: 15.0V For the first one hour, the liquid toner composition was stably ejected under the aforementioned conditions without causing the clogging (blockage) of the nozzles. The ejected amount was 5 g/min. based on the liquid toner composition, and was approximately 0.5 g/min. based on the toner after drying.

The dried and solidified toner particles were subjected to discharging by the exposure of a soft X-ray, and then were suctioned and collected by a filter having pores of 1 μm. After measuring the particle size distribution of the collected particles by a flow particle image analyzer (FPIA-2000) under the aforementioned measurement conditions, it was found that toner base particles having a mass average particle diameter (D4) of 5.8 μm, a number average particle diameter (Dn) of 4.9 μm, and D4/Dn of 1.18 were obtained.

As a result of the ejection stability test, the ejected amount after 48 hour continuous operation was lowered to 0.3 g/min., whereas the initial ejection amount was 0.5 g/min.

Figure 7:
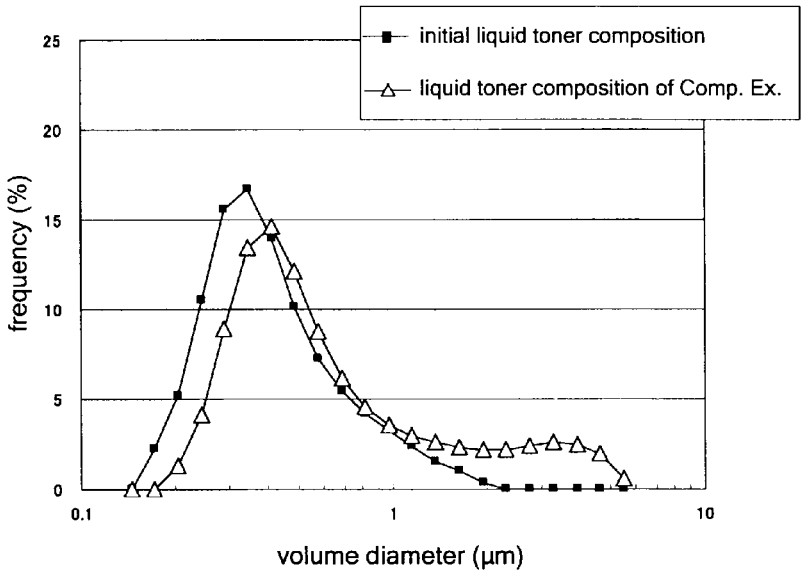
FIG. 7 is a diagram comparing the particle size distribution of the toner formed by using the initial liquid toner composition and that of the toner formed by using the liquid toner composition after ejecting for 48 hours in Comparative Example 1.

In the same manner as in Example 1, the liquid toner composition was taken out from liquid chamber 13 after continuously ejecting for 48 hours, and the solid dispersed matters thereof were subjected to the measurement of the particle diameters. As a result, the particle size distribution of the solid contents was changed from the date obtained at the time when the liquid toner composition was prepared (see FIG. 7), and the proportion of the component having a large particle diameter was increased. Considering that the diameter of the nozzle being 10 μm, the numbers of the solid dispersed matter having a diameter relatively closer to the diameter of the nozzle, and the ejected amount seemed to be decreased due to the clogging of the nozzles.

Moreover, similar to Example 1, the toner obtained after the 48 hour operation had a mass average particle diameter (D4) of 5.6 μm, a number average particle diameter (Dn) of 4.5 μm, and D4/Dn of 1.24. The particle size distribution of the toner was slightly degraded along with the unstable ejected amount.

As has been described above, the method for forming a toner of the present invention can efficiently produce a toner, and the toner obtained by such the method can be used for a developer for developing an electrostatic image in electrophotography, electrostatic recording, electrostatic printing, and the like.

According to the method for producing a toner of the present invention, the ejecting performance of the toner can be maintained over a long period of time, and can produce a toner having no change or extremely slight change in the various characteristics required for the toner, such as flowability and charging characteristics, which tend to change in the particles formed by the conventional production methods. Therefore, the present invention is suitable for a production method of a toner for electrophotography used in a copier, printer, facsimile, and a complex device thereof in the electrophotographic recording system.

What is claimed is:

1. A method for producing a toner, comprising:

ultrasonically vibrating a liquid toner composition at a vibration frequency of from 10 kHz to 200 kHz in which a toner material containing at least a binder resin and a colorant is dissolved or dispersed in a solvent;

introducing the ultrasonically vibrated liquid toner composition to a liquid chamber, and ejecting the liquid toner composition as droplets from an ejecting plate having a plurality of holes and disposed on one surface of the liquid chamber and connected to an ejecting plate vibrating unit; and drying and solidifying the droplets so as to produce a toner, wherein the ultrasonically vibrating is performed before the introducing the liquid toner composition to the liquid chamber, and wherein during the ejecting the ejecting plate vibrating unit vibrates the ejecting plate at a frequency or waveform that is the same as the ultrasonic vibrating of the liquid toner composition.

2. The method for producing a toner according to claim 1, wherein a liquid vibration unit configured to vibrate the liquid toner composition is disposed on the side of the liquid chamber facing to the ejecting plate, and the liquid toner composition is repeatedly pushed out and suctioned from the ejecting plate by the liquid vibration unit so as to eject the droplets.

3. The method for producing a toner according to claim 2, wherein the liquid vibration unit is a piezoelectric element, and an ejection condition of the droplets ejected from the ejecting plate is controlled by a voltage applied to the piezoelectric element.

4. The method for producing a toner according to claim 2, wherein the liquid vibration unit is a piezoelectric element, and an ejection condition of the droplets ejected from the ejecting plate is controlled by a frequency of a voltage applied to the piezoelectric element.

5. The method for producing a toner according to claim 1, wherein the ejecting plate is vibrated by the ejecting plate vibrating unit so as to eject the droplets.

6. The method for producing a toner according to claim 5, wherein the ejecting plate vibrating unit is a vibration ring constituted of a circular piezoelectric element bonded to an outer surface of the ejecting plate.

7. The method for producing a toner according to claim 5, wherein the ejecting plate vibrating unit is a piezoelectric element, and an ejection condition of the droplets ejected from the ejecting plate is controlled by a voltage applied to the piezoelectric element.

8. The method for producing a toner according to claim 5, wherein the ejecting plate vibrating unit is a piezoelectric element, and an ejection condition of the droplets ejected from the ejecting plate is controlled by a frequency of a voltage applied to the piezoelectric element.

9. The method for producing a toner according to claim 1, wherein after ejecting the liquid toner composition from the ejecting plate as droplets, a fall velocity of the droplets is increased or decreased by a transporting air flow.

10. The method according to claim 1, wherein ultrasonically vibrating the liquid toner composition produces a toner comprising a wax component and a pigment component that are released from an aggregated state.

11. The method according to claim 1, wherein the toner formed by the drying and solidifying consists of the components of the liquid toner composition except the solvent.

12. The method according to claim 1, wherein the ultrasonic vibration is carried out in a chamber that is in line just before the liquid chamber.

13. The method according to claim 1, wherein the ultrasonically vibrating and the ejecting are carried out with a vibration waveform comprising a plurality of superimposed frequencies.

14. The method according to claim 1, wherein the vibration frequency of the ultrasonically vibrating and the vibration frequency of the ejecting are the same.

* * * * *